US011163256B2

(12) United States Patent
Suzuki

(10) Patent No.: US 11,163,256 B2
(45) Date of Patent: Nov. 2, 2021

(54) IMAGE FORMING APPARATUS

(71) Applicant: BROTHER KOGYO KABUSHIKI KAISHA, Nagoya (JP)

(72) Inventor: Yasuhiro Suzuki, Nagoya (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 0 days.

(21) Appl. No.: 16/719,297

(22) Filed: Dec. 18, 2019

(65) Prior Publication Data

US 2020/0301345 A1 Sep. 24, 2020

(30) Foreign Application Priority Data

Mar. 22, 2019 (JP) ..... JP2019-054462

(51) Int. Cl.
*G03G 15/00* (2006.01)
*G03G 21/18* (2006.01)
(Continued)

(52) U.S. Cl.
CPC ..... *G03G 15/757* (2013.01); *G03G 15/0896* (2013.01); *G03G 21/1619* (2013.01); *G03G 21/1642* (2013.01); *G03G 21/1647* (2013.01); *G03G 21/1661* (2013.01); *G03G 21/1671* (2013.01); *G03G 21/1676* (2013.01);
(Continued)

(58) Field of Classification Search
CPC ..... G03G 15/0896; G03G 15/757; G03G 15/1619; G03G 15/1642; G03G 15/1647; G03G 15/1661; G03G 15/1671; G03G 15/1676; G03G 15/1839; G03G 15/1842; G03G 15/1857; G03G 15/1864; G03G 2215/1619
See application file for complete search history.

(56) References Cited

U.S. PATENT DOCUMENTS 6,101,349 A 8/2000 Ohashi et al.
2012/0251163 A1 10/2012 Tomatsu et al.
(Continued)

FOREIGN PATENT DOCUMENTS

JP 2000-19928 A 1/2000
JP 2012-211940 A 11/2012
(Continued)

*Primary Examiner* — Joseph S Wong
(74) *Attorney, Agent, or Firm* — Merchant & Gould P.C.

(57) ABSTRACT

An image forming apparatus, having a casing, a drum unit including first and second lateral walls and first and second photosensitive drums, first and second cartridges supported by the drum unit, first and second operable members, is provided. The first operable member and the second operable member press the first developing cartridge and the second developing cartridge, respectively, in a direction from the first lateral wall toward the second lateral wall to move the first and second developing rollers from the respective contacting positions to respective separated positions. The casing includes a restrictive portion. When the drum unit is attached to the casing, the restrictive portion restricts movement of the drum unit causable by at least one of a pressing action of the first operable member to press the first developing cartridge and a pressing action of the second operable member to press the second developing cartridge.

22 Claims, 23 Drawing Sheets

(51) Int. Cl.
*G03G 21/16* (2006.01)
*G03G 15/08* (2006.01)

(52) U.S. Cl.
CPC ..... *G03G 21/1839* (2013.01); *G03G 21/1842* (2013.01); *G03G 21/1857* (2013.01); *G03G 21/1864* (2013.01); *G03G 2215/1619* (2013.01)

(56) References Cited

U.S. PATENT DOCUMENTS

| | | | | |
|---|---|---|---|---|
| 2012/0308259 | A1* | 12/2012 | Abe ..... | G03G 15/0194 399/110 |
| 2014/0126929 | A1 | 5/2014 | Tomatsu | |
| 2014/0294425 | A1 | 10/2014 | Okabe | |
| 2015/0301497 | A1* | 10/2015 | Kawanami ..... | G03G 21/1647 399/121 |
| 2019/0302674 | A1* | 10/2019 | Wang ..... | G03G 21/1619 |

FOREIGN PATENT DOCUMENTS

| | | | |
|---|---|---|---|
| JP | 2013-127653 | A | 6/2013 |
| JP | 2014-92676 | A | 5/2014 |
| JP | 2014-199334 | A | 10/2014 |
| JP | 2017-26938 | A | 2/2017 |

* cited by examiner 90
183
920
63D
95
95A
183B
94
60
181
RIGHT
REAR
FRONT
LEFT
63
92
184
182
182B
172
152A
150
171
170
182A
64
910

FIG. 19A
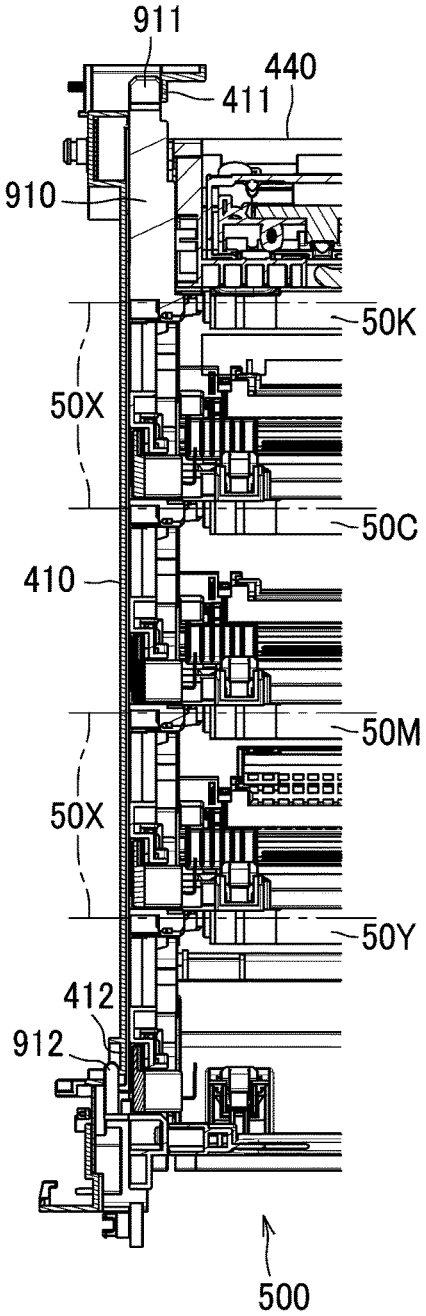
FIG. 19B
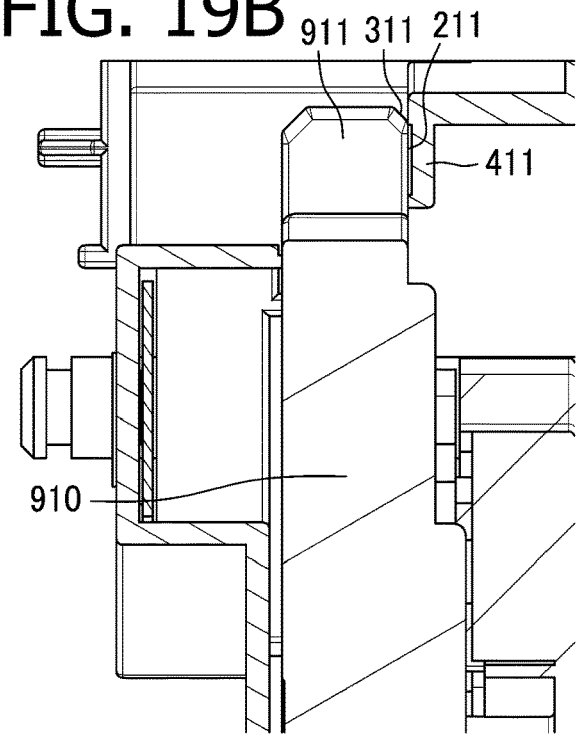
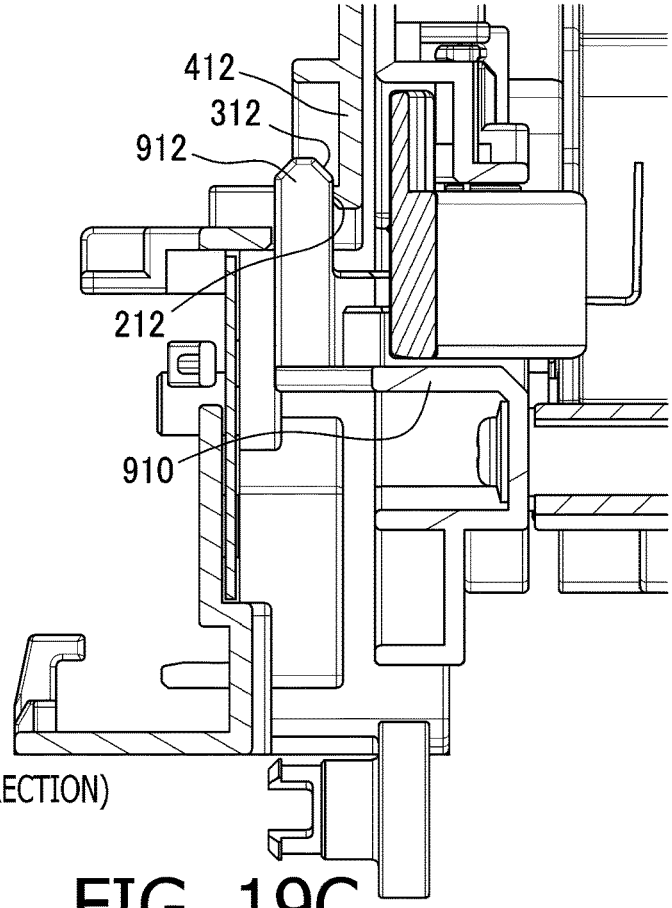
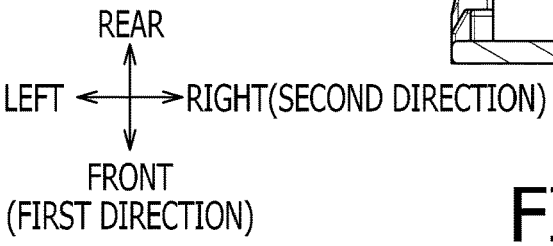
FIG. 19C

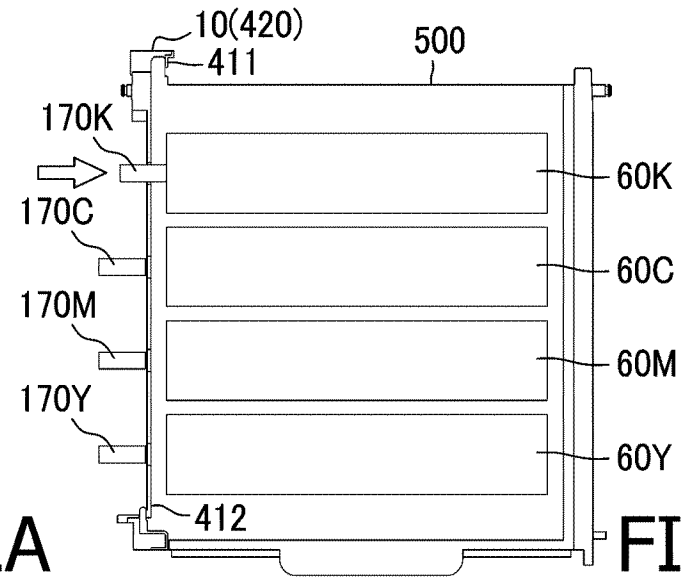
FIG. 22A
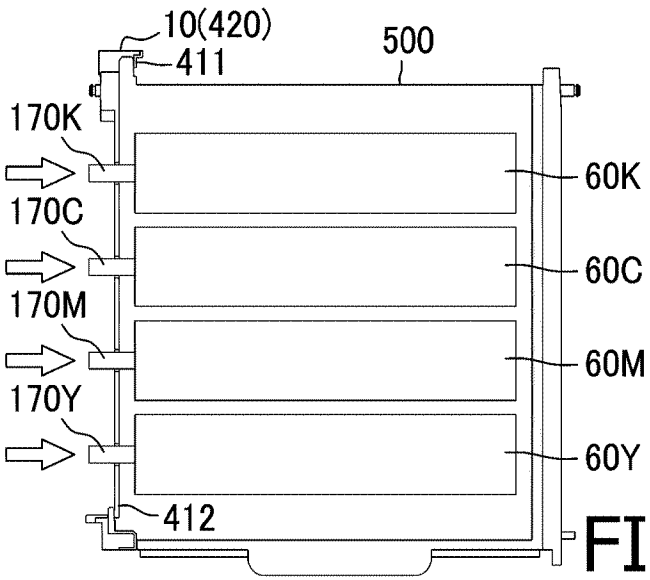
FIG. 22B
FIG. 22C
FIG. 22D

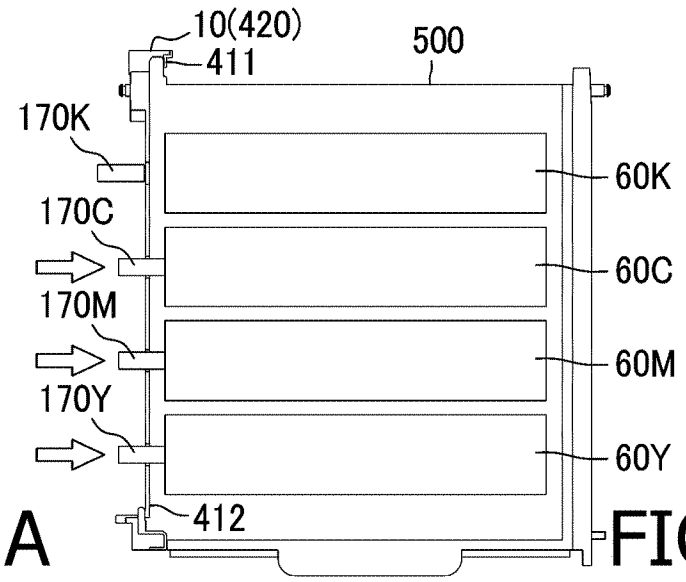
FIG. 23A
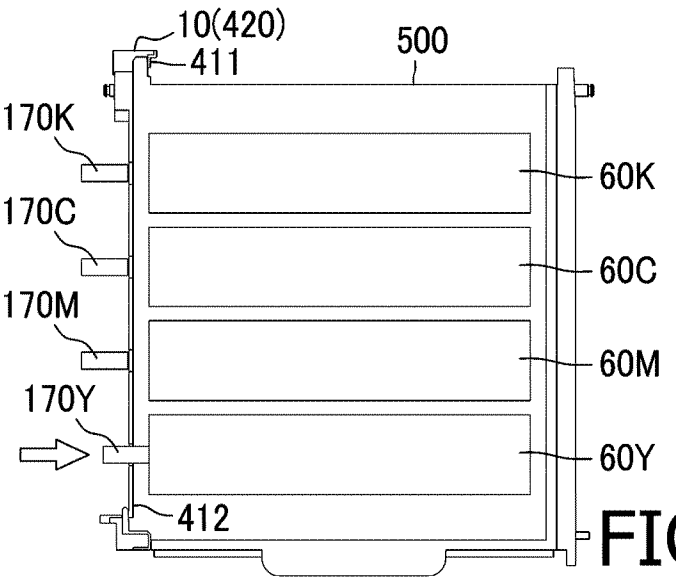
FIG. 23B
FIG. 23C
FIG. 23D

IMAGE FORMING APPARATUS

CROSS REFERENCE TO RELATED APPLICATION

This application claims priority from Japanese Patent Application No. 2019-054462, filed on Mar. 22, 2019, the entire subject matter of which is incorporated herein by reference.

BACKGROUND

Technical Field

An aspect of the present disclosure is related to an image forming apparatus capable of forming an electrophotographic image having a drum unit, which is removably attachable to a housing.

Related Art

An image forming apparatus with a housing, to which a drum unit including a photosensitive drum is removably attachable, is known. For example, a color printer may have housing which accommodates an exposure device, and a drum unit with a plurality of photosensitive drums arranged therein in tandem may be disposed in the housing at a lower position with respect to the exposure device removably alongside developing rollers.

SUMMARY

The drum unit may have cutouts formed at rear ends of lateral walls thereof, and the cutouts may fit with a shaft that extends in a crosswise direction in the housing so that the drum unit may be placed at a correct position in a vertical direction and in a front-rear direction at a rearward portion. At a frontward portion of the drum unit, meanwhile, the drum unit may have a shaft that extends in the crosswise direction, and crosswise ends of the shaft may be placed to contact a locator member arranged at a frontward position in the housing from above so that the drum unit may be placed at a correct position in the vertical direction. In this regard, however, a position of the drum unit in the crosswise direction, or an axial direction, i.e., a direction parallel to rotation axes of the photosensitive drums, is not considered. Displacement of the drum unit with respect to the housing in the crosswise direction may affect an image forming quality of the color printer to some extent.

The present disclosure is advantageous in that an image forming apparatus, in which a drum unit may be placed steadily at a correct position not only in the front-rear and vertical directions but also in the crosswise direction, provided.

According to an aspect of the present disclosure, an image forming apparatus, having a casing, a drum unit, a first developing cartridge, a second developing cartridge, a first operable member, and a second operable member, is provided. The drum unit is detachably attachable to the casing. The drum unit is detachable from the casing by being dawn outward in a drawing-out direction with respect to the casing. The drum unit includes a first lateral wall and a second lateral wall arranged to be spaced apart from each other in a direction orthogonal to the drawing-out direction, and a first photosensitive drum and a second photosensitive drum arranged to be spaced apart from each other in the drawing-out direction. The first photosensitive drum and the second photosensitive drum are supported rotatably by the first lateral wall and the second lateral wall to rotate about axes extending orthogonally to the drawing-out direction. The first developing cartridge is supported by the drum unit at a position corresponding to the first photosensitive drum. The first developing cartridge including a first developing roller configured to contact the first photosensitive drum. The first developing cartridge is movable between a position, in which the first developing roller is located at a contacting position to contact the first photosensitive drum, and a position, in which the first developing roller is located at a separated position to be separated from the first photosensitive drum. The second developing cartridge is supported by the drum unit at a position corresponding to the second photosensitive drum. The second developing cartridge includes a second developing roller configured to contact the second photosensitive drum. The second developing cartridge is movable between a position, in which the second developing roller is located at a contacting position to contact the second photosensitive drum, and a position, in which the second developing roller is located at a separated position to be separated from the second photosensitive drum. The first operable member is arranged in the casing at a position corresponding to the first developing cartridge. The first operable member is configured to press the first developing cartridge in a direction from the first lateral wall toward the second lateral wall to move the first developing roller from the contacting position to the separated position. The second operable member is arranged in the casing at a position corresponding to the second developing cartridge. The second operable member is configured to press the second developing cartridge in the direction from the first lateral wall toward the second lateral wall to move the second developing roller from the contacting position to the separated position. The casing includes a restrictive portion. When the drum unit is attached to the casing, the casing restricts movement of the drum unit causable by at least one of a pressing action of the first operable member to press the first developing cartridge and a pressing action of the second operable member to press the second developing cartridge.

According to another aspect of the present disclosure, an image forming apparatus, including a casing, a drum unit, a first developing cartridge, a second developing cartridge, a first operable member, and a second operable member, is provided. The casing includes a first side-frame. The drum unit is configured to be drawn outward in a first direction with respect to the casing. The drum unit includes a first lateral wall including a first opening and a second opening, a second lateral wall arranged to be spaced apart from the first lateral wall in a second direction extending orthogonally to the first direction, a first photosensitive drum arranged between the first lateral wall and the second lateral wall rotatably to rotate about a rotation axis being parallel to the second direction, and a second photosensitive drum arranged between the first lateral wall and the second lateral wall at a position spaced apart from the first photosensitive drum in the first direction rotatably to rotate about a rotation axis being parallel to the second direction. The drum unit is supported by the first side-frame through the first lateral wall to be movable along the first direction between a stored position, in which the first photosensitive drum and the second photosensitive drum are located inside the casing, and a drawn-out position, in which the first photosensitive drum and the second photosensitive drum are located outside the casing. The first developing cartridge includes a first developing roller. When the first developing cartridge is attached to the drum unit, the first developing cartridge is movable between a position, in which the first developing roller being located at a contacting position contacts the first photosensitive drum, and a position, in which the first developing roller being located at a separated position is separated from the first photosensitive drum. The second developing cartridge includes a second developing roller. When the second developing cartridge is attached to the drum unit, the second developing cartridge is movable between a position, in which the second developing roller being located at a contacting position contacts the second photosensitive drum, and a position, in which the second developing roller being located at a separated position is separated from the second photosensitive drum. The first operable member is arranged on the first side-frame at a position corresponding to the first developing cartridge. The first operable member is configured to move through the first opening in the first lateral wall and press the first developing cartridge in the second direction to move the first developing roller from the contacting position to the separated position. The second operable member is arranged on the first side-frame at a position corresponding to the second developing cartridge. The second operable member is configured to move through the second opening in the first lateral wall and press the second developing cartridge in the second direction to move the second developing roller from the contacting position to the separated position. The first lateral wall includes a first engageable portion and a second engageable portion. The second engageable portion is arranged at a position spaced apart from the first engageable portion in the first direction. The first side-frame includes a first restrictive portion and a second restrictive portion. When the drum unit is located at the stored position, engagement of the first engageable portion with the first restrictive portion and engagement of the second engageable portion with the second restrictive portion restrict movement of the drum unit causable by at least one of a pressing action of the first operable member to press the first developing cartridge and a pressing action of the second operable member to press the second developing cartridge. When the drum unit is located at the drawn-out position, the first engageable portion is disengaged from the first restrictive portion and the second engageable portion is disengaged from the second restrictive portion.

According to another aspect of the present disclosure, an image forming apparatus, including a casing, a drum unit, a first side-frame, a second side-frame, and a connecting member, is provided. The drum unit is configured to be drawn outward in a first direction from the casing. The drum unit includes a first lateral wall including a first engageable portion and a second engageable portion arranged to be spaced apart from the first engageable portion in the first direction, a second lateral wall arranged to be spaced apart from the first lateral wall in a second direction extending orthogonally to the first direction, and a photosensitive drum arranged between the first lateral wall and the second lateral wall rotatably to rotate about a rotation axis being parallel to the second direction. The first side-frame is arranged inside the casing. The first side-frame is configured to support the first lateral wall movably to aid the drum unit to move along the first direction between a stored position, in which the photosensitive drum is located inside the casing, and a drawn-out position, in which the photosensitive drum is located outside the casing. The first side-frame includes a first restrictive portion configured to, when the drum unit is located at the stored position, engage with the first engageable portion, and a second restrictive portion configured to, when the drum unit is located at the stored position, engage with the second engageable portion. The second side-frame is arranged inside the casing to be spaced apart from the first side-frame in the second direction. The connecting member connects the first side-frame and the second side-frame with each other. The connecting member is configured to, when the drum unit is located at the stored position with the first lateral wall and the second lateral wall contacting the connecting member, locate the drum unit at a correct position with respect to the casing in the first direction. When the drum unit moves from the drawn-out position to the stored position, movement of the drum unit in the second direction is restricted earlier by the engagement of the first engageable portion with the first restrictive portion and the engagement of the second engageable portion with the second restrictive portion, and movement of the drum unit in the first direction is restricted later by contact of the first lateral wall and the second lateral wall with the connecting member.

According to another aspect of the present disclosure, an image forming apparatus, having a casing, a drum unit, a developing cartridge, and an operable member, is provided. The casing includes a first side-frame. The drum unit is configured to be drawn outward in a first direction with respect to the casing. The drum unit includes a first lateral wall, a second lateral wall, and a photosensitive drum. The first lateral wall includes an opening. The second lateral wall is arranged to be spaced apart from the first lateral wall in a second direction. The second direction extends orthogonally to the first direction. The photosensitive drum is arranged between the first lateral wall and the second lateral wall. The photosensitive drum is rotatable about a rotation axis being parallel to the second direction. The drum unit is supported by the first side-frame through the first lateral wall to be movable along the first direction between a stored position, in which the photosensitive drum is located inside the casing, and a drawn-out position, in which the photosensitive drum is located outside the casing. The developing cartridge includes a developing roller. The developing cartridge is movable between a first position, in which the developing roller contacts the photosensitive drum, and a second position, in which the developing roller is separated from the photosensitive drum. The operable member is arranged on the first side-frame at a position corresponding to the developing cartridge. The operable member is configured to move through the opening in the first lateral wall and press the developing cartridge in the second direction to move the developing cartridge from the first position to the second position. The first lateral wall includes a first engageable portion and a second engageable portion. The second engageable portion is arranged at a position spaced apart from the first engageable portion in the first direction. The first side-frame includes a first restrictive portion and a second restrictive portion. When the drum unit is located at the stored position, engagement of the first engageable portion with the first restrictive portion and engagement of the second engageable portion with the second restrictive portion restrict movement of the drum unit causable by a pressing action of the operable member to press the developing cartridge. When the drum unit is located at the drawn-out position, the first engageable portion is disengaged from the first restrictive portion and the second engageable portion is disengaged from the second restrictive portion.

BRIEF DESCRIPTION OF THE ACCOMPANYING DRAWINGS

Figure 13A:
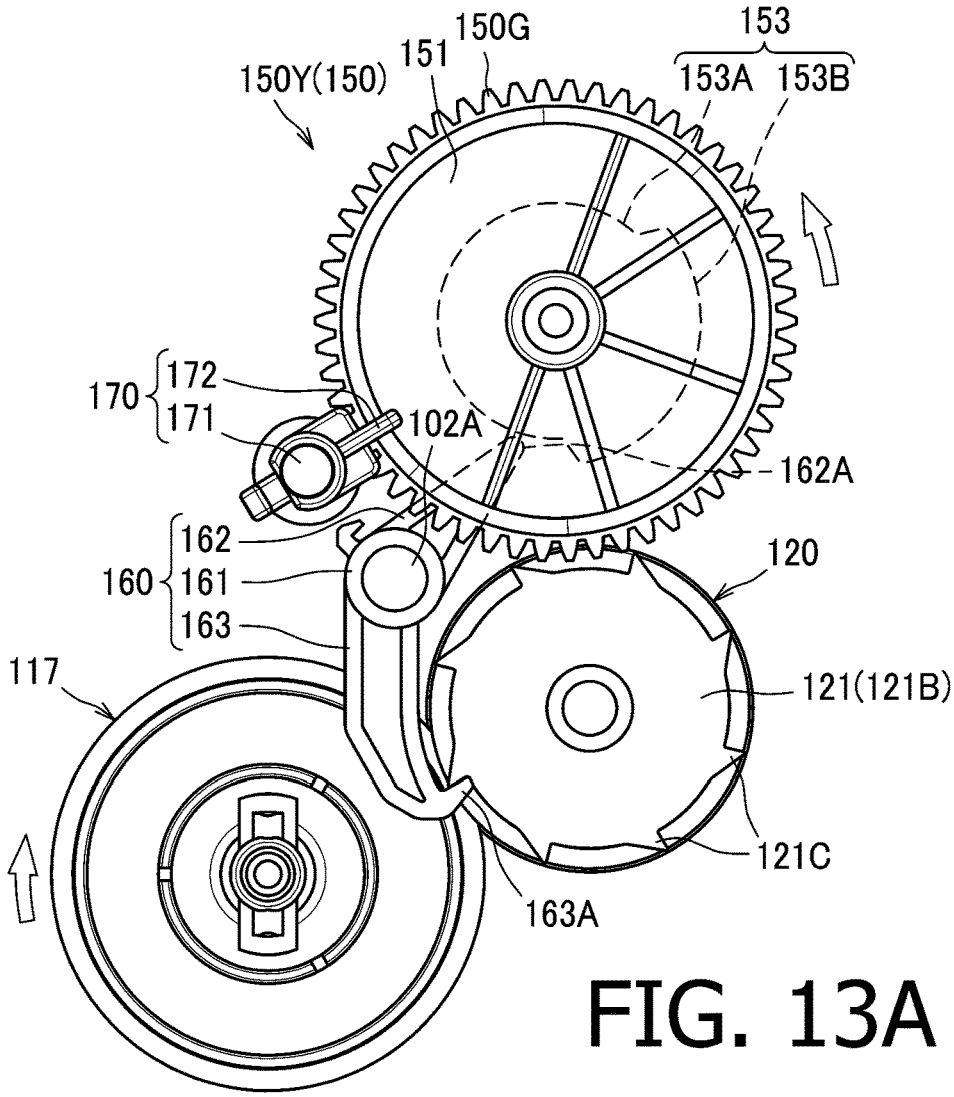
FIGS. 13A and 13B are a side view of a moving mechanism with a clutch in a transmittable condition, alongside a lever and a coupling gear, viewed along the axial direction, and a perspective view of the moving mechanism, respectively, in the image forming apparatus according to the embodiment of the present disclosure.
Figure 13B:
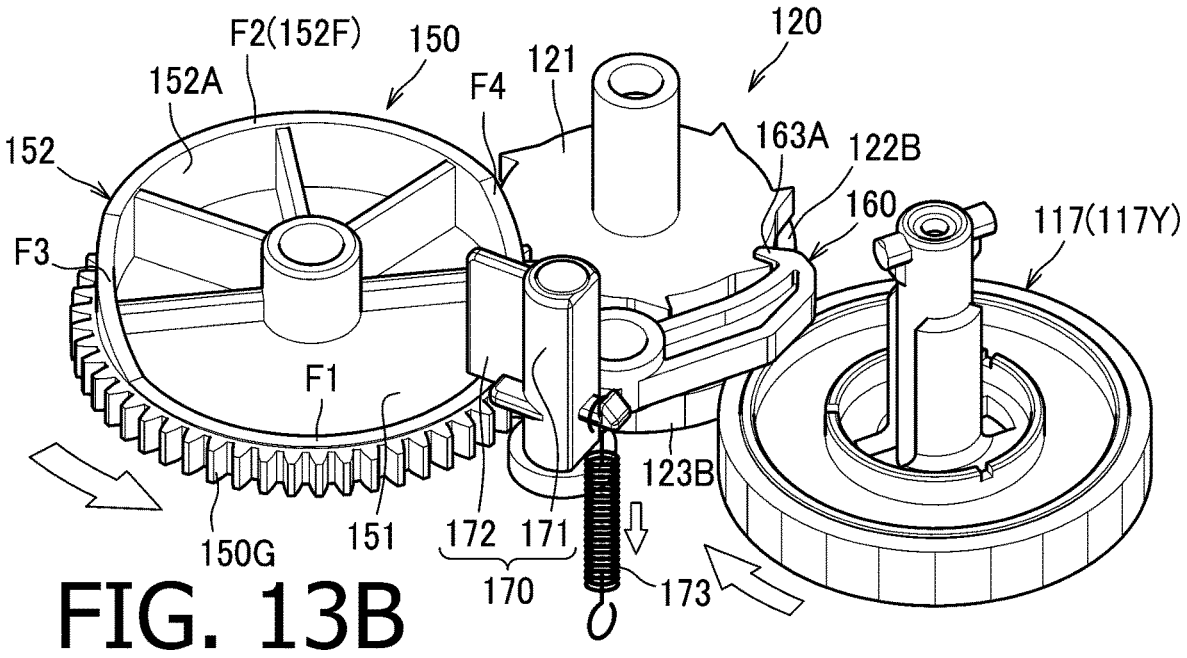
Figure 14A:
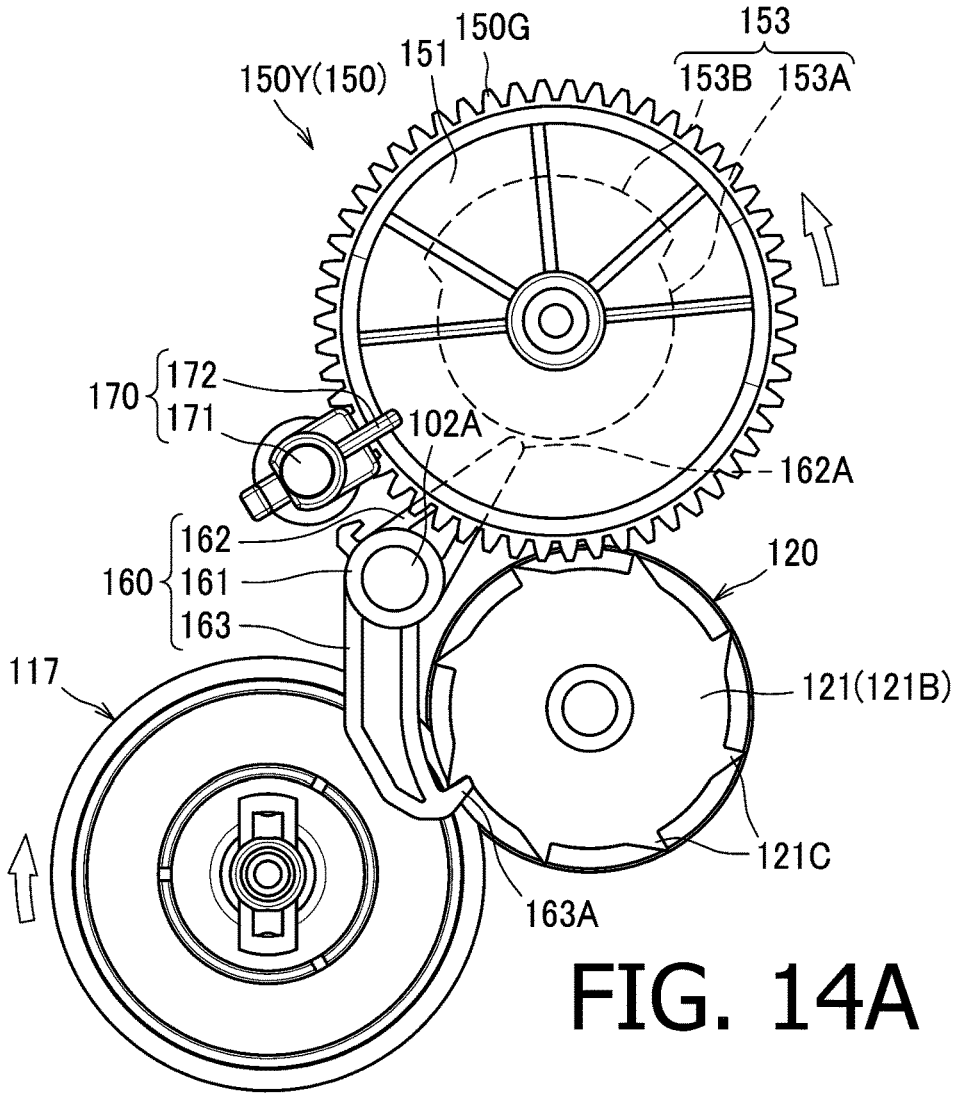
Figure 14B:
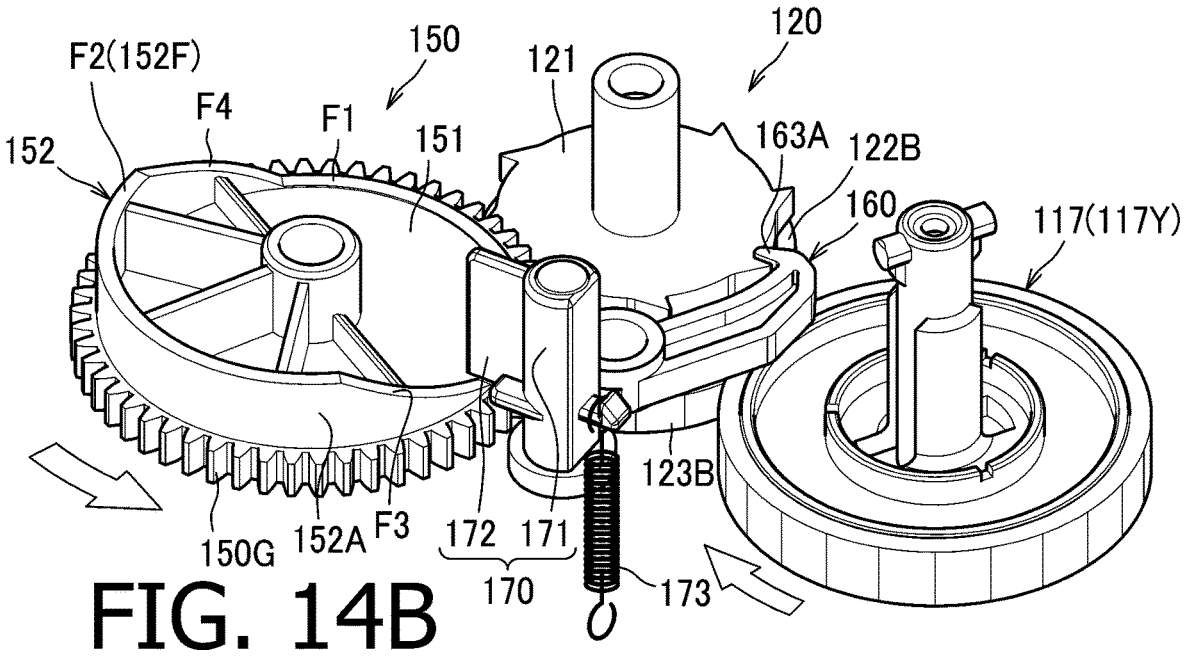

FIGS. 14A and 14B are a side view of the moving mechanism with the cam rotated from the position shown in FIGS. 13A-13B, alongside the lever, the clutch, and the coupling gear, when a developing roller for yellow is at a contacting position to form an image, viewed along the axial direction, and a perspective view of the moving mechanism, respectively, in the image forming apparatus according to the embodiment of the present disclosure.

Figure 15A:
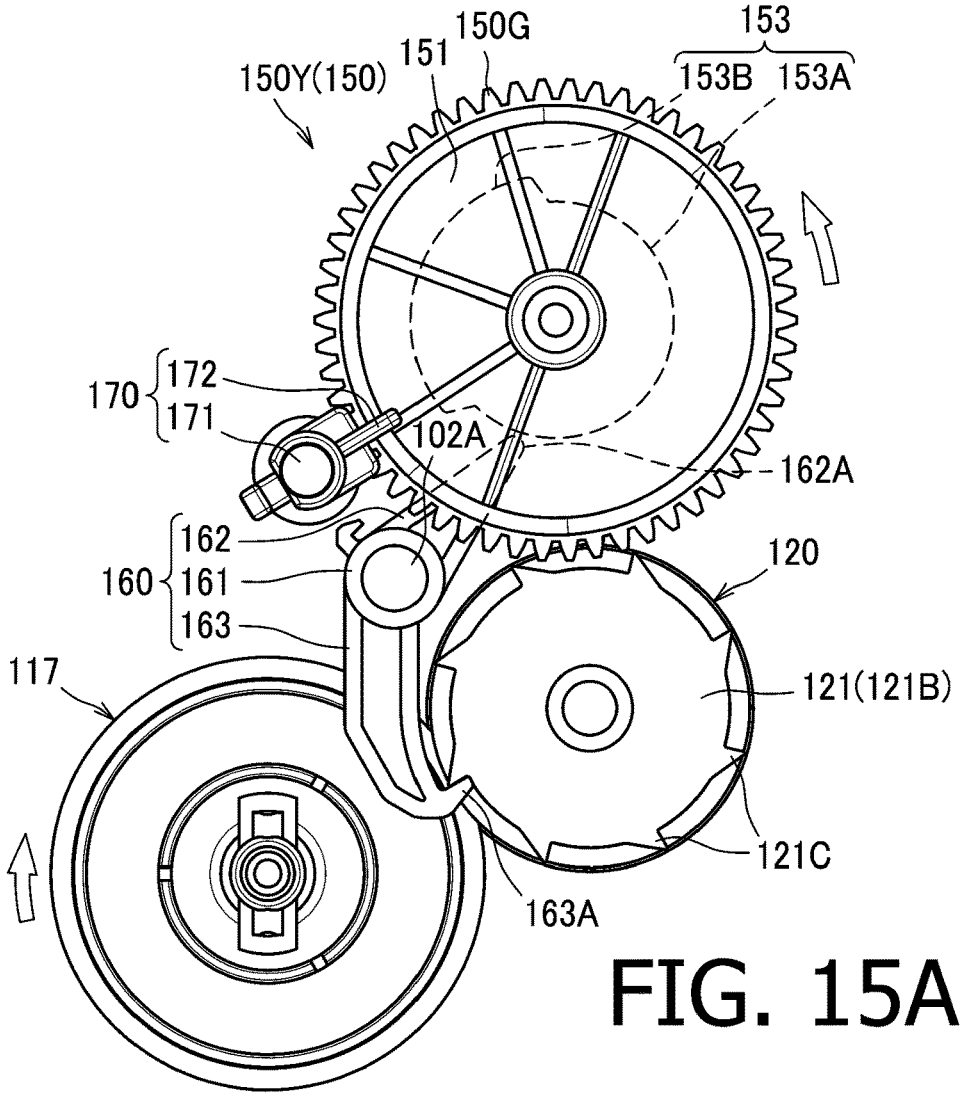
Figure 15B:
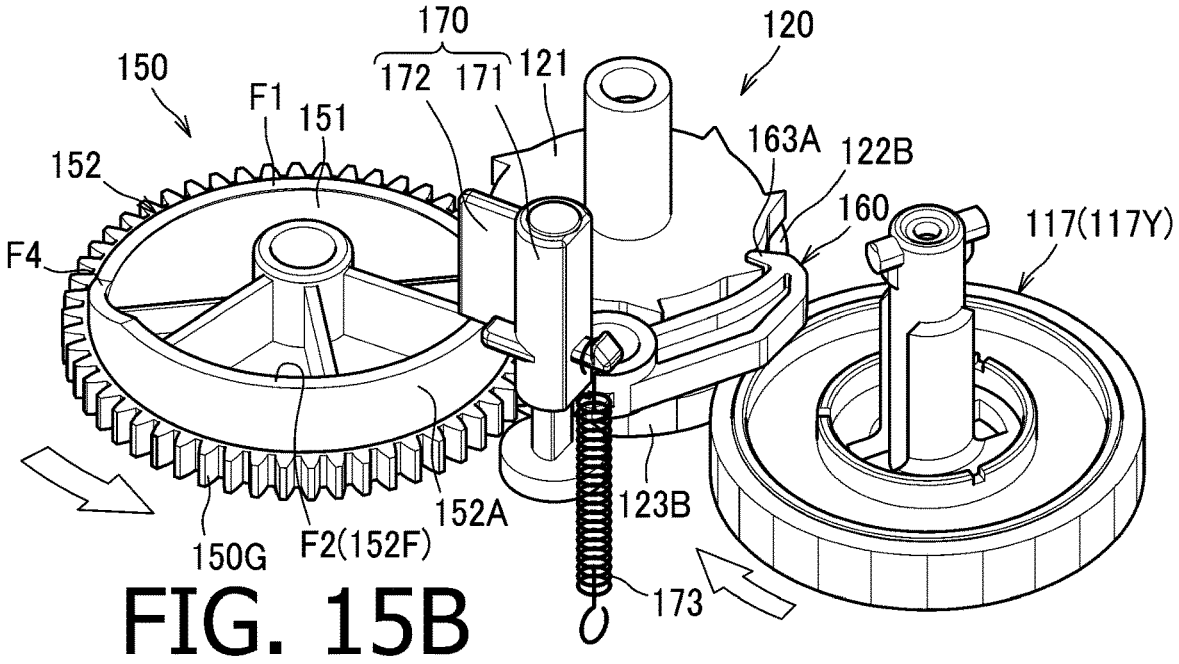

FIGS. 15A and 15B are a side view of the moving mechanism with the cam rotated from the position shown in FIGS. 14A-14B, alongside the lever, the clutch, and the coupling gear, when the developing roller is at a separated position and the clutch is in the transmittable condition, viewed along the axial direction, and a perspective view of the moving mechanism, respectively, in the image forming apparatus according to the embodiment of the present disclosure.

Figure 16A:
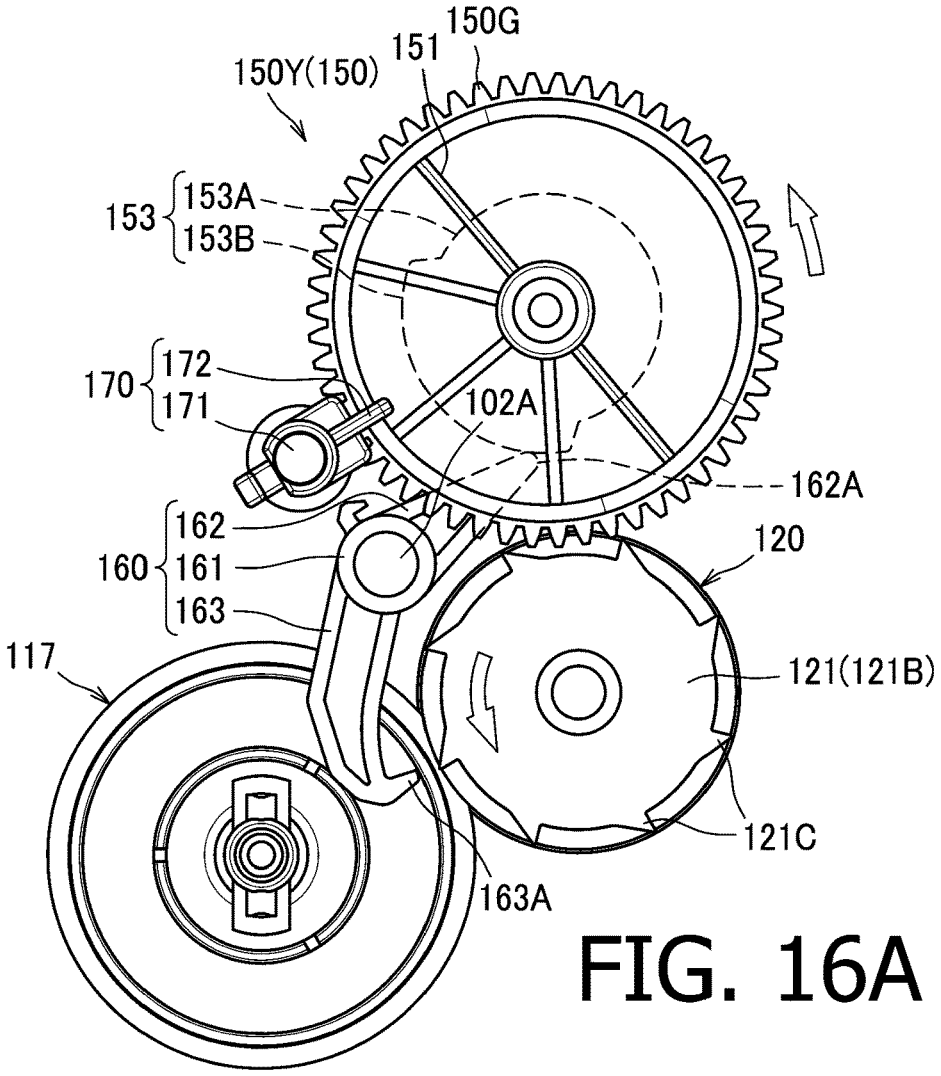
Figure 16B:
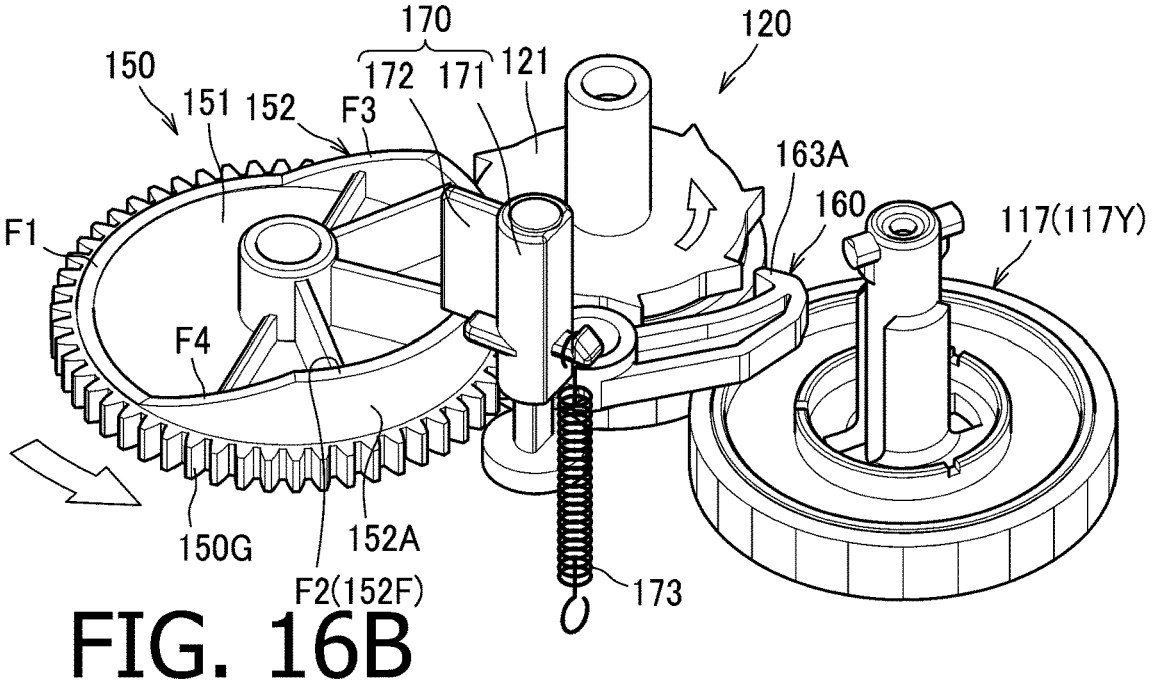

FIGS. 16A and 16B are a side view of the moving mechanism with the cam rotated from the position shown in FIGS. 15A-15B, alongside the lever, the clutch, and the coupling gear, when the developing roller is at the separated position and the clutch is in a discontinuing condition, viewed along the axial direction, and a perspective view of the moving mechanism, respectively, in the image forming apparatus according to the embodiment of the present disclosure.

Figure 17A:
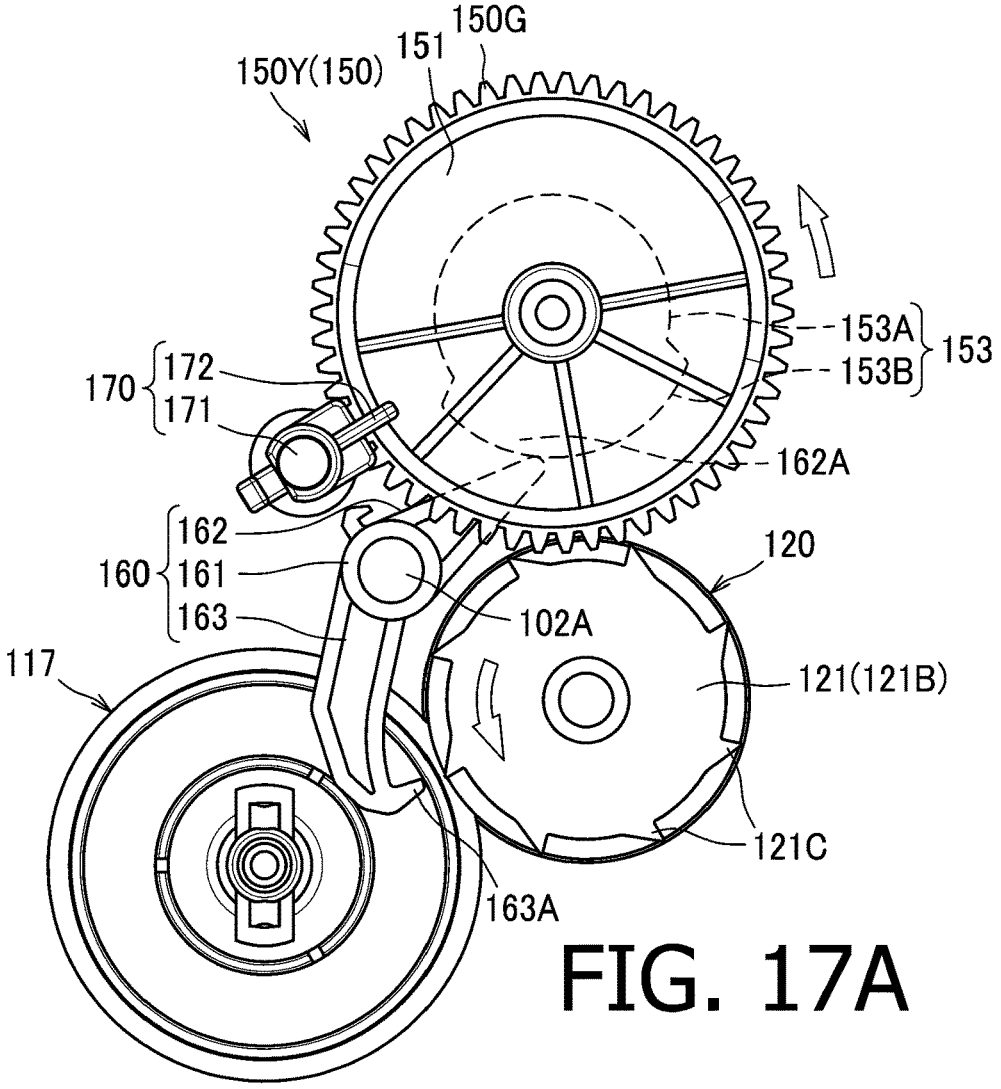
Figure 17B:
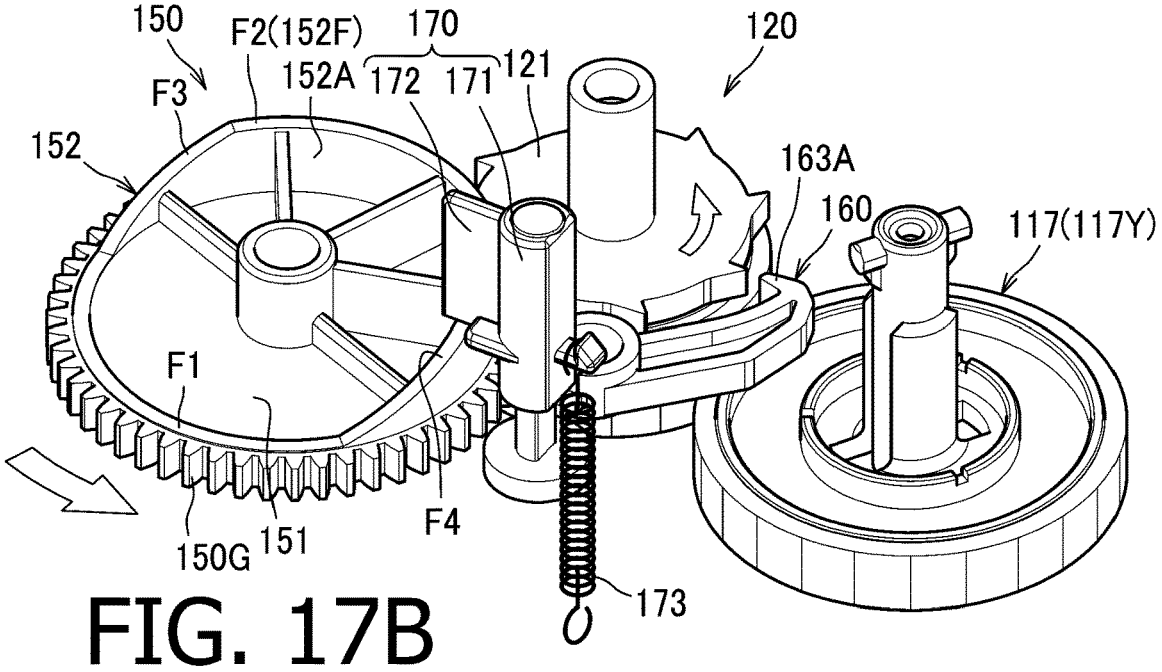

FIGS. 17A and 17B are a side view of the moving mechanism with the cam rotated from the position shown in FIGS. 16A-16B, alongside the lever, the clutch, and the coupling gear, when the developing roller for yellow is pausing before moving to the contacting position, viewed along the axial direction, and a perspective view of the moving mechanism, respectively, in the image forming apparatus according to the embodiment of the present disclosure.

Figure 18:
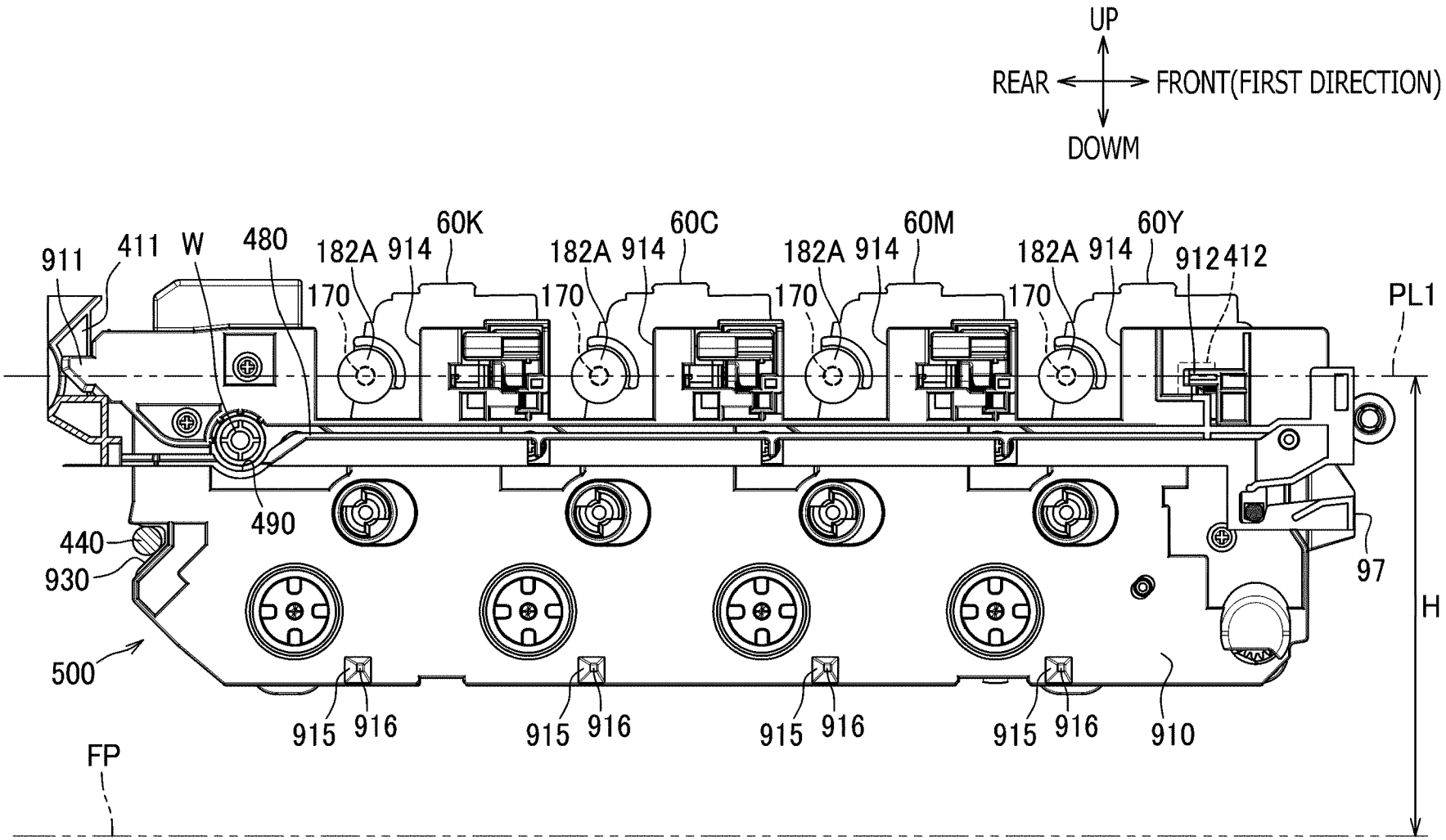

FIG. 18 is a side view of the drum unit located at a stored position in the image forming apparatus, viewed along the axial direction, according to the embodiment of the present disclosure.

FIG. 19A is an illustrative view of overall engagement of a first and second restrictive portions in a first side-frame of the image forming apparatus according to the embodiment of the present disclosure. FIGS. 19B-19C are partially enlarged views of the first restrictive portion and the second restrictive portion, respectively, in the first side-frame of the image forming apparatus according to the embodiment of the present disclosure.

Figure 20:
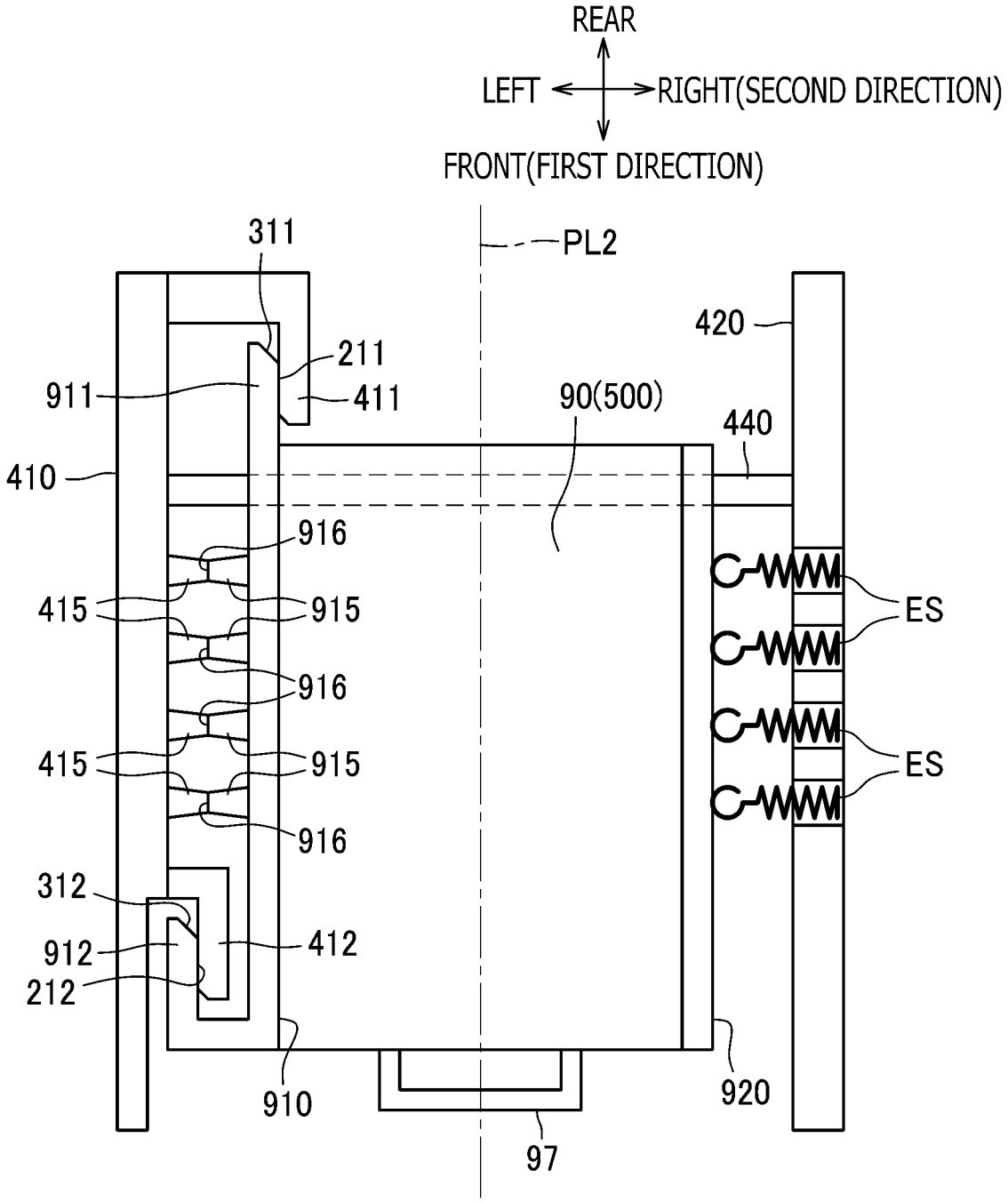

FIG. 20 illustrates an arrangement of the first and second restrictive portions and a first and second protrusions in the image forming apparatus according to the embodiment of the present disclosure.

Figure 21A:
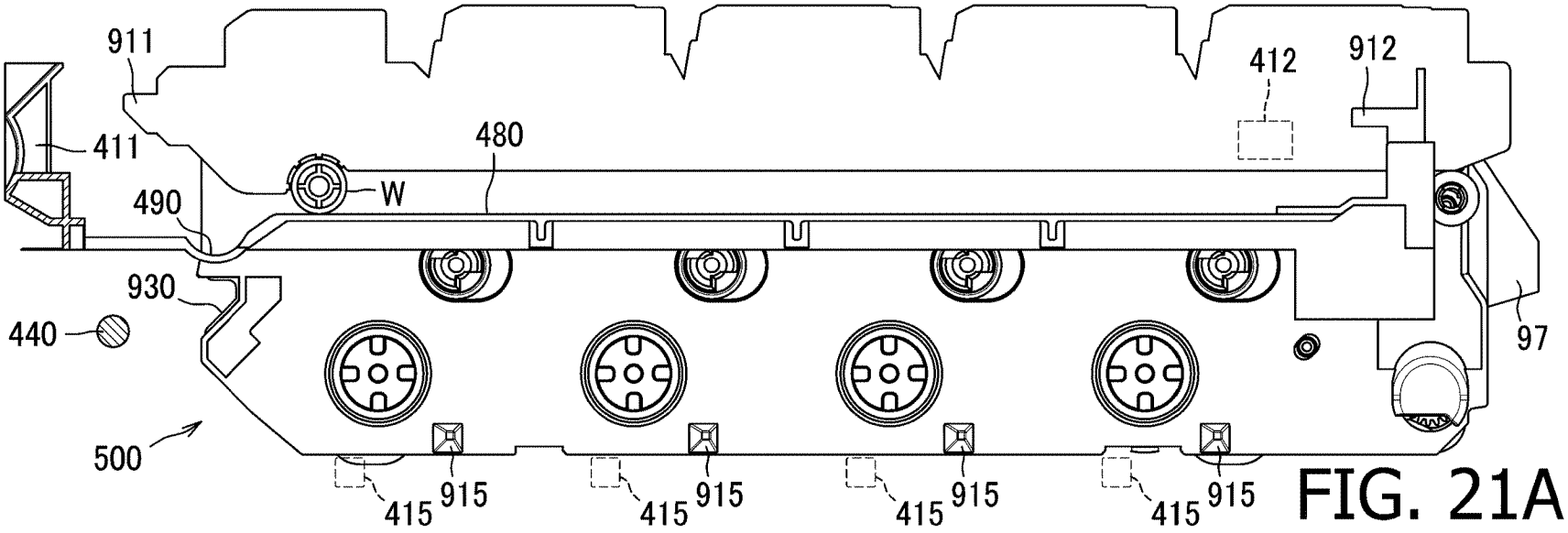
Figure 21B:
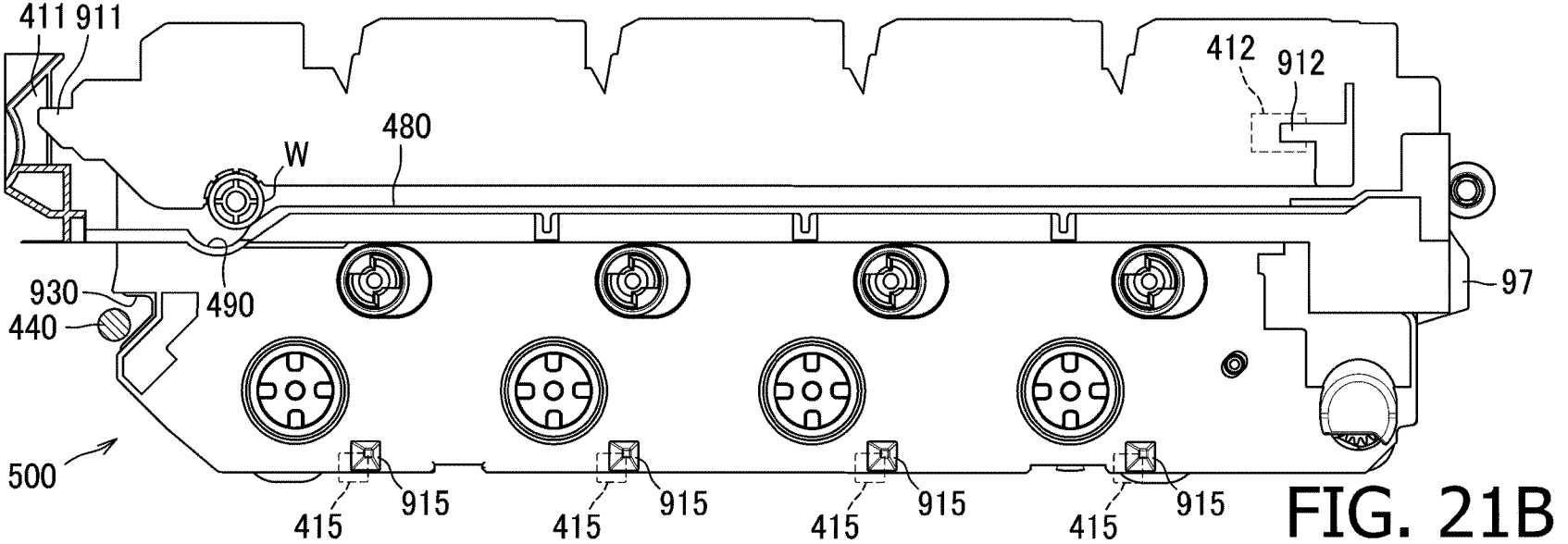

FIG. 21A is an illustrative view of the drum unit being attached to the housing, in a state before engagement of the first and second restrictive portions and a recessed portion in the drum unit with first and second engageable portions and the connecting pipe in the housing, respectively, in the image forming apparatus according to the embodiment of the present disclosure. FIG. 21B is an illustrative view of the drum unit being attached to the housing, in a state after engagement of the first and second restrictive portions in the drum unit with the first and second engageable portions in the housing, respectively, and before engagement of the recessed portion in the drum unit with the connecting pipe in the housing, in the image forming apparatus according to the embodiment of the present disclosure.

FIGS. 22A-22D illustrate standing-by and acting movements of cam followers when a multicolored image is printed in the image forming apparatus according to the embodiment of the present disclosure.

FIGS. 23A-22D illustrate standing-by and acting movements of cam followers continued from the movements shown in FIGS. 22A-22D when the multicolored image is printed in the image forming apparatus according to the embodiment of the present disclosure.

DETAILED DESCRIPTION

Hereinafter, described with reference to the accompanying drawings will be an embodiment of the present disclosure.

Figure 1:
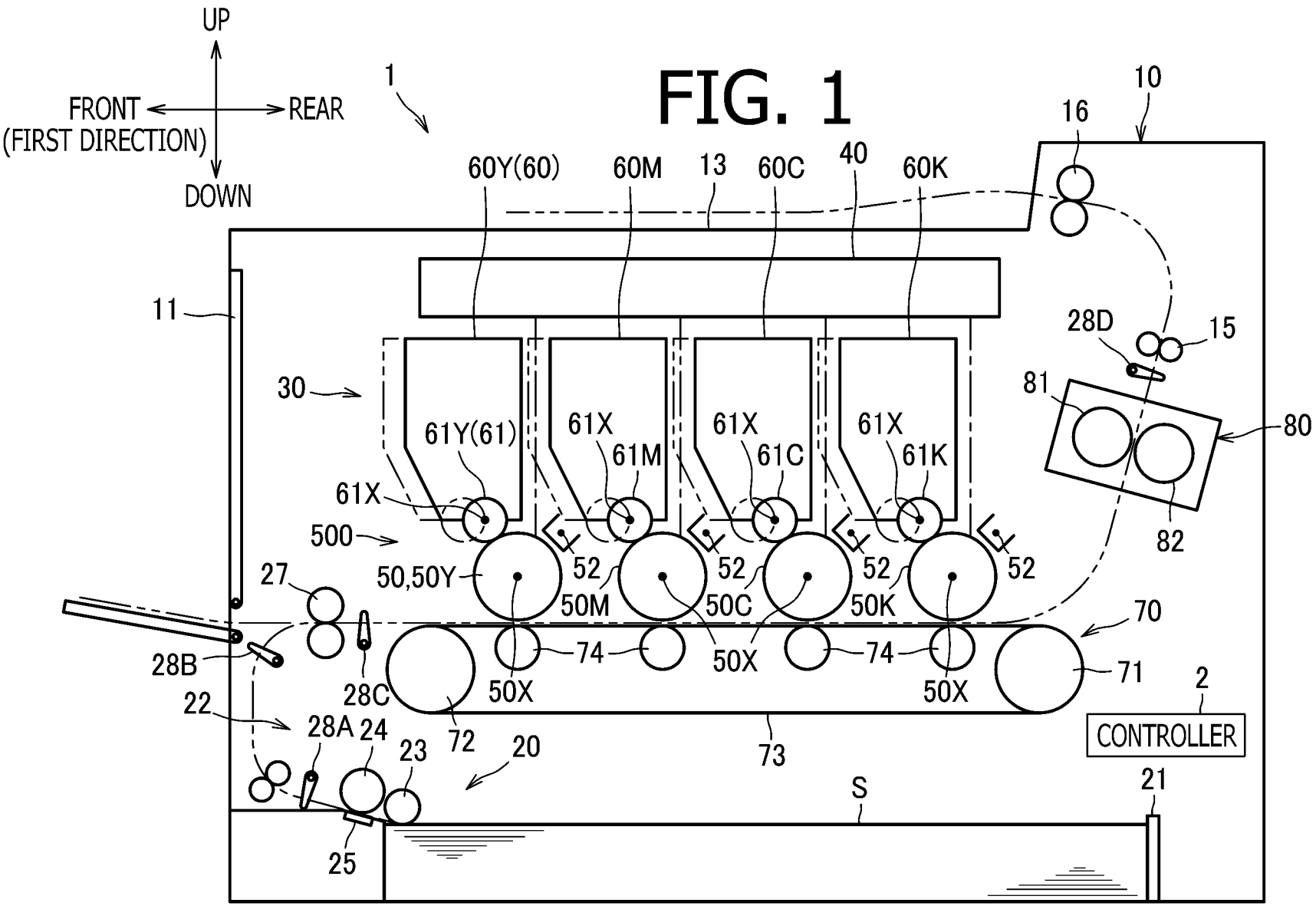
FIG. 1 is an overall cross-sectional view of an image forming apparatus according to an embodiment of the present disclosure.

As shown in FIG. 1, an image forming apparatus 1 according to the embodiment is a multicolor printer and has a casing 10, which accommodates a sheet feeder 20, an image forming device 30, and a controller 2.

The sheet feeder 20 is arranged at a lower position in the casing 10 and includes a sheet tray 21 to store sheets S and a feeder device 22 to feed the sheets S from the sheet tray 21 to the image forming device 30. The sheet tray 21 is movable to be pulled frontward, e.g., leftward in FIG. 1, to be detached from the casing 10. The feeder device 22 is arranged at a frontward position in the casing 10 and includes a feeder roller 23, a separator roller 24, a separator pad 25, and a registration roller 27. In the following description, directions related the image forming apparatus 1 and each part or item included in the image forming apparatus 1 will be referred to on basis of indications by arrows in FIG. 1. For example, in FIG. 1, a viewer's a left-hand side, a right-hand side, an upper side, and a lower side will be referred to as a front side, a rear side, an upper side, and a lower side, respectively. Moreover, the viewer's farther side and nearer side within FIG. 1 will be referred to as a leftward side and a rightward side in the image forming apparatus 1, respectively. A front-to-rear or a rear-to-front direction may be referred to as a front-rear direction, a left-to-right or right-to-left direction may be referred to as a widthwise direction, and an up-to-down or down-to-up direction may be referred to as a vertical direction. The sheet(s) S in the present embodiment is a printing medium, on which the image forming apparatus 1 may form an image, and includes, but not necessarily be limited to, regular paper, envelope, postcard, tracing paper, cardboard, resin sheet, and sticker sheet.

In the sheet feeder 20, one of the sheets S in the sheet tray 21 may be picked up by the feeder roller 23 and separated from the other sheets S by the separator roller 24 and the separator pad 25. As the separated sheet S is conveyed further, a position of a leading edge of the sheet S may be regulated by the registration roller 27, which may be pausing. Thereafter, as the registration roller 27 starts rotating, the sheet S may be fed to the image forming device 30. At a position downstream from the separator roller 24 in a conveying direction to convey the sheet S, arranged is a feeder sensor 28A, which may detect the sheet S passing thereby. At a position upstream from the registration roller 27 in the conveying direction, arranged is a pre-registration sensor 28B, which may detect the sheet S passing thereby. At a position downstream from the registration roller 27 in the conveying direction, arranged is a post-registration sensor 28C.

The image forming device 30 includes an exposure device 40, a drum unit 500, a plurality of developing cartridges 60, a conveyer 70, and a fuser 80.

The exposure device 40 includes laser diodes, deflectors, lenses, and mirrors, which are not shown. The exposure device 40 may emit laser beams at the photosensitive drums 50 to expose photosensitive drums 50 to the light and to scan surfaces of the photosensitive drums 50.

Figure 4:
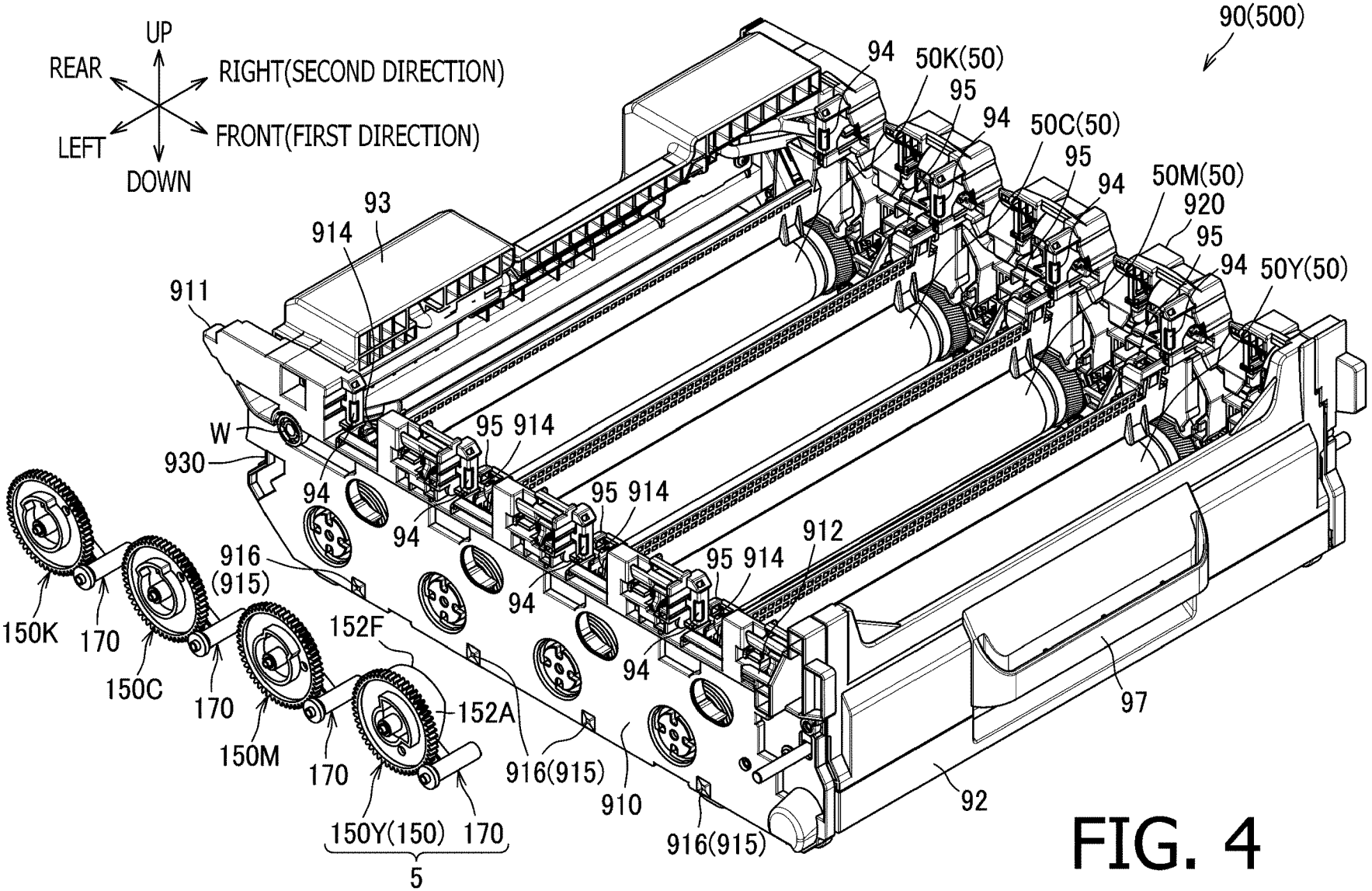
FIG. 4 is a perspective view of a supporting member, cams, and cam followers in the image forming apparatus according to the embodiment of the present disclosure.

The drum unit 500 includes a plurality of, e.g., four (4), photosensitive drums 50, a plurality of chargers 52, which are provided in one-to-one correspondence to the photosensitive drums 50, and a supporting member 90 (see FIG. 4). The drum unit 500 is attachable to and removable from the casing 10 by being pushed inward, or rearward, and drawn outward, or frontward, through an opening (not shown), which is exposed when a front cover 11 is open. Each of the photosensitive drums 50 is supported rotatably by the supporting member 90 to rotate about an axis 50X, which extends orthogonally to a drawing-out direction, in which the drum unit 500 may be drawn out from the casing 10.

The photosensitive drums 50 include a first photosensitive drum 50Y a second photosensitive drum 50M, a third photosensitive drum 50C, and a fourth photosensitive drum 50K, which are provided correspondingly to a first color, a second color, a third color, and a fourth color, respectively. The first, second, third, and fourth colors may be, for example, yellow, magenta, cyan, and black. In the following paragraphs and the accompanying drawings, a color to which an item corresponds may be identified by a suffix Y, M, C, or K, representing yellow, magenta, cyan, or black, respectively, appended to a reference sign of the item. On the other hand, when items are described generally without necessity of referring to the corresponding colors thereto, the items may be described representatively in a singular form with a single reference sign without the suffix Y, M, C, or K; and the ordinal terms (e.g., first, second, etc.) may be omitted.

The developing cartridge 60 is supported by the drum unit 500, more specifically, by the supporting member 90 which will be described further below, at a position corresponding to the photosensitive drum 50. In particular, the developing cartridge 60 includes a first developing cartridge 60Y a second developing cartridge 60M, a third developing cartridge 60C, and a fourth developing cartridge 60K. The first developing cartridge 60Y includes a first developing roller 61Y, which may contact the first photosensitive drum 50Y. The second developing cartridge 60M includes a second developing roller 61M, which may contact the second photosensitive drum 50M. The third developing cartridge 60C includes a third developing roller 61C, which may contact the third photosensitive drum 50C. The fourth developing cartridge 60K includes a fourth developing roller 61K, which may contact the fourth photosensitive drum 50K.

The first developing roller 61Y, the second developing roller 61M, the third developing roller 61C, and the fourth developing roller 61K are arranged in line in this recited order from upstream to downstream along a sheet-moving direction. In other words, the first developing roller 61Y is at a most upstream position, and the fourth developing roller 61K is at a most downstream position, in the sheet-moving direction for the sheet S. The sheet-moving direction is a direction, in which the sheet S is conveyed in the conveyer 70 (e.g., rearward in FIG. 1 and rightward to a viewer).

The developing cartridge 60 is movable between a position, in which the developing roller 61 being at a contacting position contacts the corresponding photosensitive drum 50, as indicated by solid lines in FIG. 1, and a position, in which the developing roller 61 being at a separated position is separated from the corresponding photosensitive drum 50, as indicated by dash-and-dots lines in FIG. 1. The second developing cartridge 60M, the third developing cartridge 60C, and the fourth developing cartridge 60K are, when the second developing roller 61M, the third developing roller 61C, and the fourth developing roller 61K are located at the respective separated positions, located at positions displaced from positions thereof when the second developing roller 61M, the third developing roller 61C, and the fourth developing roller 61K are located at the respective contacting positions in a direction orthogonal to a rotation axis 61X of the developing roller 61, which is parallel to the rotation axis 50X of the photosensitive drum 50. Therefore, the second developing cartridge 60M, the third developing cartridge 60C, and the fourth developing cartridge 60K coincide with light paths for the laser beams emitted from the exposure device 40 for scanning the first photosensitive drum 50Y, the second photosensitive drum 50M, and the third photosensitive drum 50C, which correspond to the first developing cartridge 60Y, the second developing cartridge 60M, and the third developing cartridge 60C adjoining upstream in the sheet-moving direction from the second developing cartridge 60M, the third developing cartridge 60C, and the fourth developing cartridge 60K, respectively. In other words, when the second developing roller 61M is at the separated position, the second developing cartridge 60M is in a position to interrupt the light path of the laser beam emitted at the first photosensitive drum 50Y; when the third developing roller 61C is at the separated position, the third developing cartridge 60C is in a position to interrupt the light path of the laser beam emitted at the second photosensitive drum 50M; and when the fourth developing roller 61K is at the separated position, the fourth developing cartridge 60K is in a position to interrupt the light path of the laser beam emitted at the third photosensitive drum 50C.

Figure 2:
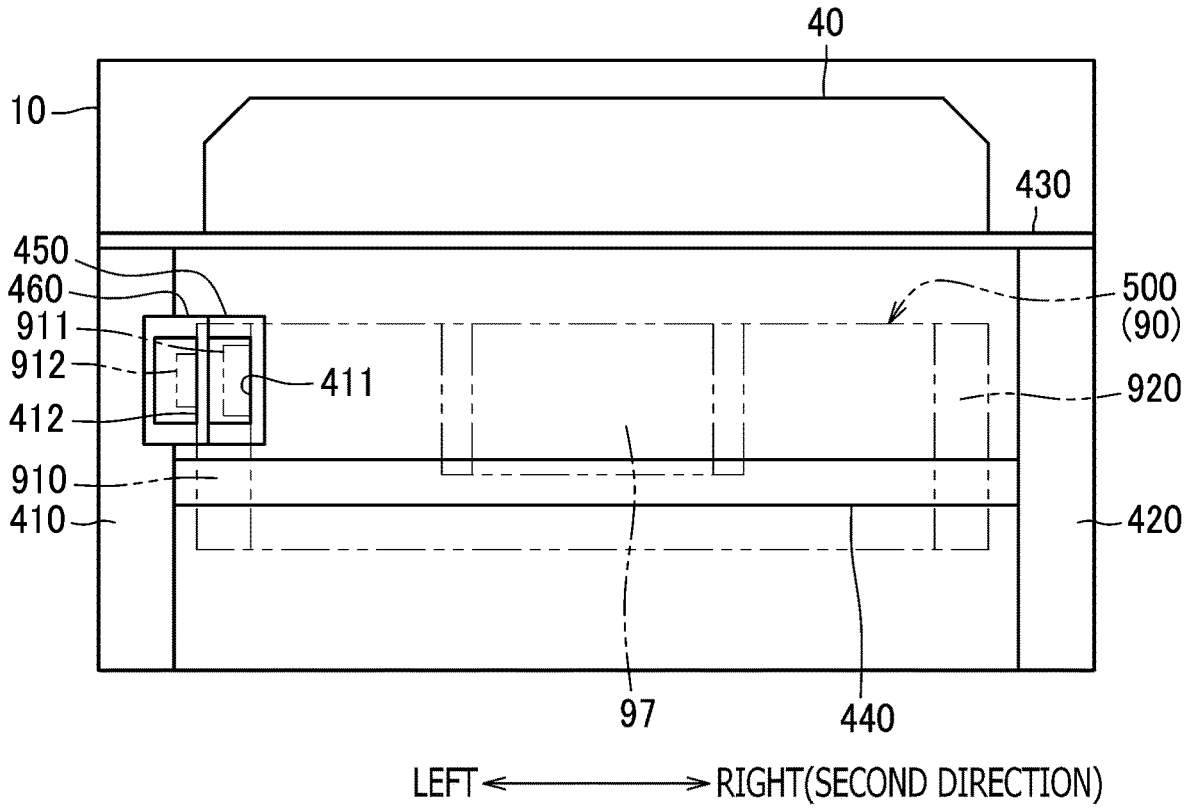
FIG. 2 illustrates an arrangement of a housing, an exposure device, and a drum unit in the image forming apparatus according to the embodiment of the present disclosure.

As shown in FIG. 2, the casing 10 includes a first side-frame 410 arranged on a leftward side, a second side-frame 420 arranged on a rightward side, a connecting plate 430, a connecting pipe 440, a first restrictive portion 411, and a second restrictive portion 412. While the drum unit 500 may be drawn outward from the casing 10 in a first direction, which is the drawing-out direction, e.g., from rear to front in FIG. 1, the second side-frame 420 is spaced apart from the first side-frame 410 in a second direction, e.g., a direction from left to right in FIG. 2, which is orthogonal to the first direction. The first restrictive portion 411 and the second restrictive portion 412 are arranged in the first frame 410 at positions spaced apart from each other in the first direction.

The connecting plate 430 includes a metal plate that connects an upper part of the first side-frame 410 and an upper part of the second side-frame 410 with each other. The exposure device 40 is fixed to an upper surface of the connecting plate 430.

Figure 3:
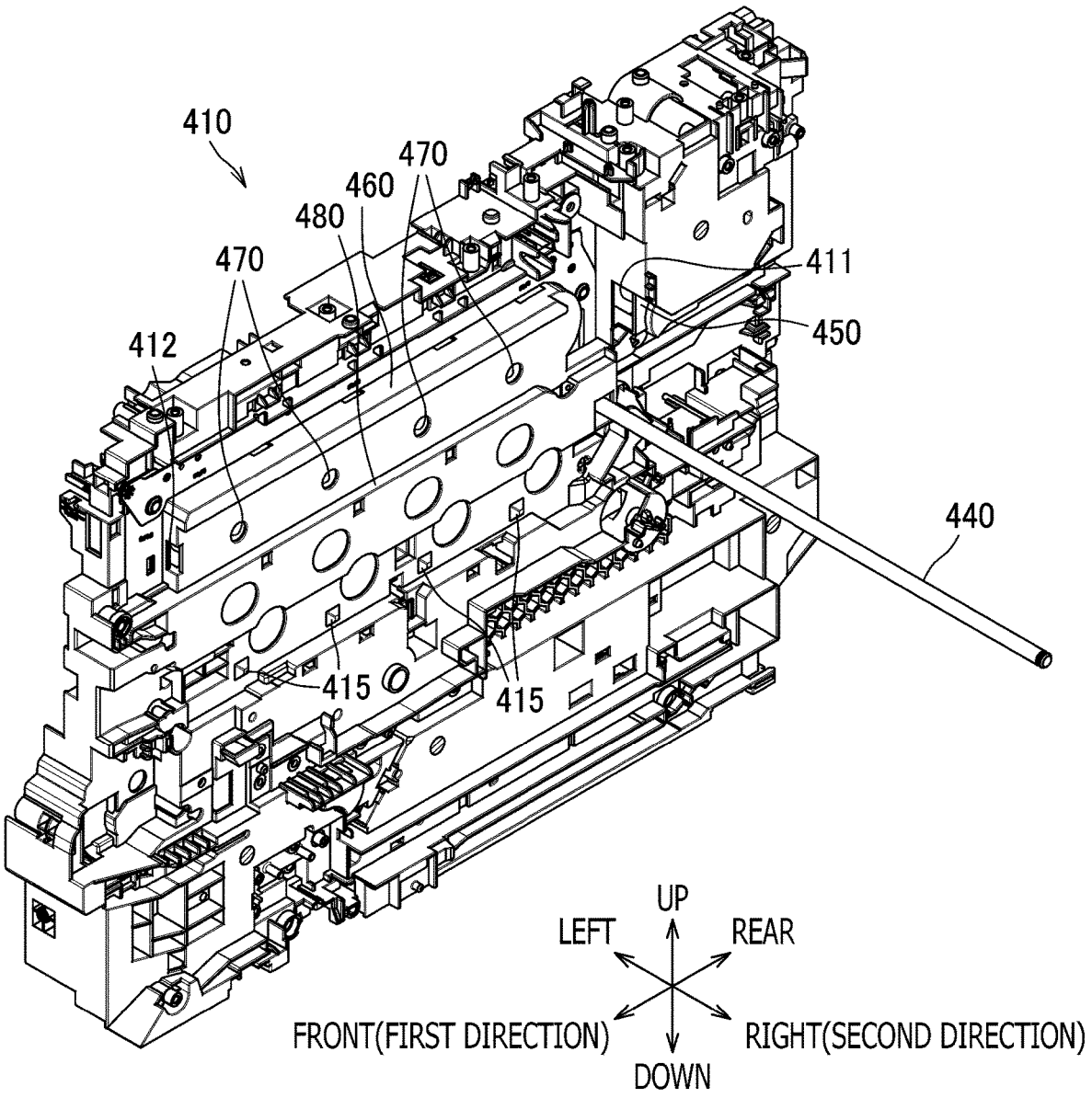
FIG. 3 is a perspective view of a first side-frame and a connecting pipe in the image forming apparatus according to the embodiment of the present disclosure.

The connecting pipe 440 is arranged at a position corresponding to engageable recessed portions 930, which are arranged at an inner, or rearward, position in the drum unit 500 in the drawing-out direction, and connects the first side-frame 410 and the second side-frame 420 with each other (see also FIGS. 3 and 18).

As shown in FIG. 4, the supporting member 90 of the drum unit 500 includes a first lateral wall 910 arranged on a leftward side, a second lateral wall 920 arranged on a rightward side, a connecting frame 92 connecting front portions of the first lateral wall 910 and the second lateral wall 920 with each other, and a connecting frame 93 connecting rear portions of the first lateral wall 910 and the second lateral wall 920 with each other.

The first lateral wall 910 and the second lateral wall 920 are arranged to be spaced apart from each other in a direction orthogonal to the drawing-out direction or to the first direction. In other words, the second lateral wall 920 is arranged to be spaced apart from the first lateral wall 910 in a rightward direction being the second direction (see FIG. 2). The engageable recessed portion 930 is arranged at an inner end of the first wall 910 and an inner end of the second wall 920 in the drawing-out direction. The first lateral wall 910 includes a first engageable portion 911 and a second engageable portion 912 spaced apart from the first engageable portion 911 in the first direction, at upper positions with respect to the engageable recessed portion 930.

As shown in FIG. 2, when the drum unit 500 is attached to the casing 10, the first side-frame 410 is arranged to cover an outer face of the first lateral wall 910, which is a sideward face facing opposite to or away from the second lateral wall 920; and the second side-frame 420 is arranged to cover an outer face of the second lateral wall 920, which is a sideward face facing opposite to or away from the first lateral wall 910. Moreover, when the drum unit 500 is attached to the casing 10, the first engageable portion 911 and the second engageable portion 912 engage with the first restrictive portion 411 and the second restrictive portion 412, respectively, which are arranged in the first side-frame 410 of the casing 10.

The supporting member 90 is provided with chargers 52 (see FIG. 1), which are arranged in one-to-one correspondence to face the first, second, third, and fourth photosensitive drums 50. As shown in FIG. 4, first, second, third, and fourth photosensitive drums 50 are arranged to be spaced apart from one another in the first direction in positions between the first lateral wall 910 and the second lateral wall 920 and are supported rotatably by the first lateral wall 910 and the second lateral wall 920 to rotate about rotation axes 50X (see FIG. 1), which are parallel to the second direction. The supporting member 90 supports the first, second, third, and fourth developing cartridges 60Y, 60M, 60C, 60K removably. The connecting frame 92 on the front as shown in FIG. 4 includes a handle 97. A user may grab the handle 97, which may be exposed when the front cover 11 (see FIG. 1) of the casing 10 is open, to draw the drum unit 500 outward from the casing 11 or push inward in the casing 11.

The image forming apparatus 1 includes four (4) moving mechanisms 5, each of which may move one of the first, second, third, and fourth developing cartridges 60Y, 60M, 60C, 60K between the position, in which the developing roller 61 therein is located at the contacting position to contact the corresponding photosensitive drum 50, and the position, in which the developing roller 61 therein is located at the separated position to be separated from the corresponding photosensitive drum 51. Thus, four (4) moving mechanisms 5 are provided for the first, second, third, and fourth colors.

Each moving mechanism 5 includes a cam 150 and a cam follower 170. The cam 150 is rotatable about an axis, which is parallel to a rotation axis 61X (see FIG. 1) of the developing roller 61. The cam 150 includes a cam 150Y for yellow, a cam 150M for magenta, a cam 150C for cyan, and a cam 150K for black. The cam follower 170 may push the corresponding one of the first, second, third, and fourth developing cartridges 60Y, 60M, 60C, 60K to move the corresponding one of the first, second, third, and fourth developing rollers 61Y, 61M, 61C, 61K from the contacting position to the separated position. The moving mechanisms 5 are accommodated inside an inner cover 460 (see FIG. 3) in the first side-frame 410 and are arranged at positions corresponding to the first, second, third, and fourth developing cartridges 60Y, 60M, 60C, 60K. The cam follower 170 is arranged such that a rightward end thereof protrudes through an opening 470 formed in the inner cover 460 and extends through an opening 914 formed in the first lateral wall 910 (see FIG. 4) to reach the inner side of the supporting member 90.

Figures 6A, 6B:
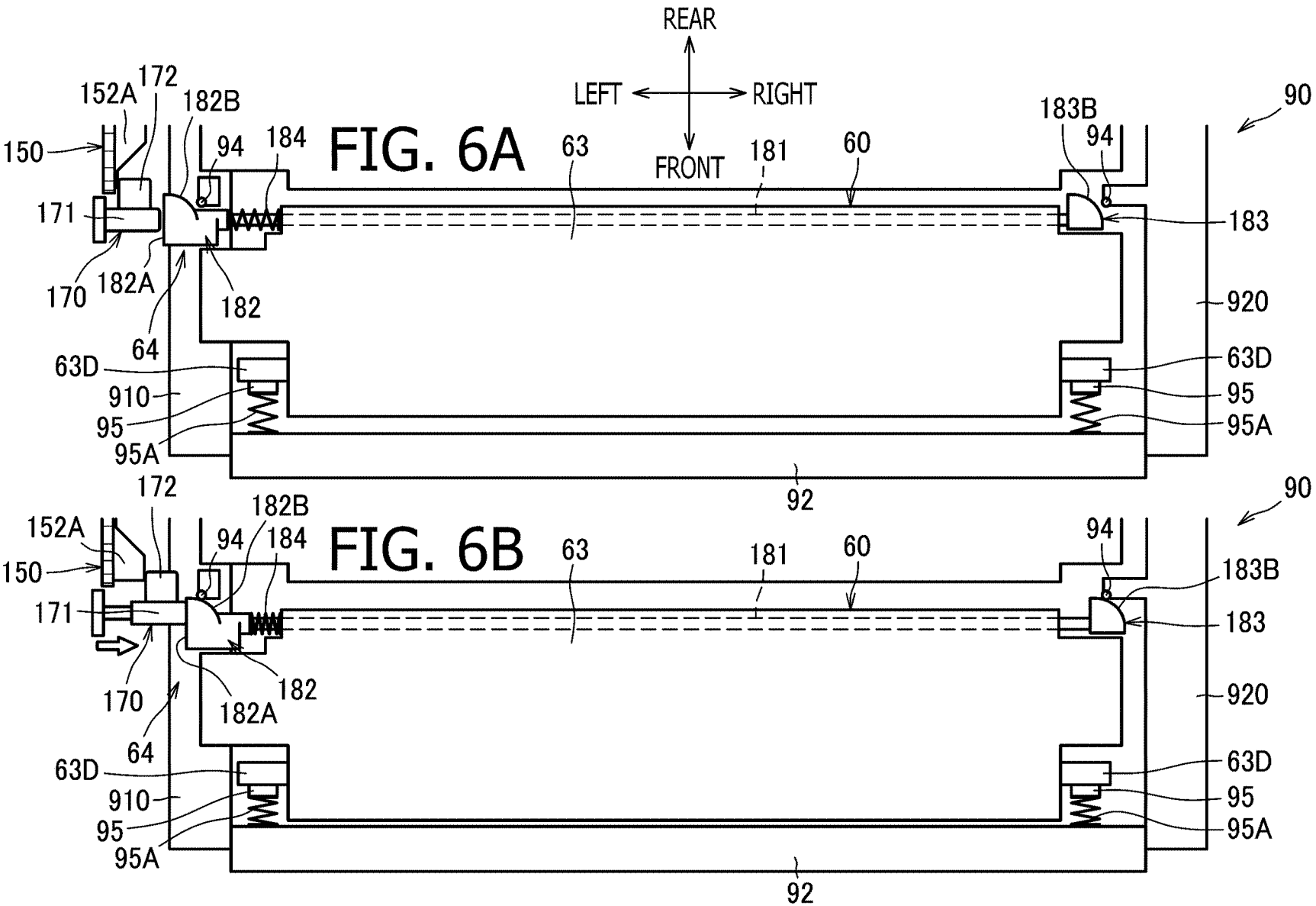
FIG. 6A is an illustrative view of the developing cartridge and periphery thereof when the cam follower is at a standby position.
FIG. 6B is an illustrative view of the developing cartridge and the periphery thereof when the cam follower is at an operable position.

Each cam 150 includes a first cam portion 152A protruding in a rotation-axis direction, which is a direction of the rotation axis 61X of the developing roller 61. The cam follower 170 is movable between an operable position, in which the cam follower 170 contacts a cam face 152F being an end face of the first cam portion 152A to place the developing roller 61 at the separated position as shown in FIG. 6B, and a standby position, in which the cam follower 170 causes the developing roller 61 to be placed at the contacting position as shown in FIG. 6A. The cam follower 170 may contact the first cam portion 152A of the cam 150 and, by the rotation of the cam 150, slidably move in the second direction from the side of the first lateral wall 910 to the operable position through the opening 914 in the first lateral wall 910 to urge the developing cartridge 60 from the side toward the first lateral wall 910. The cam follower 170 is, when at the standby position, separated from the developing cartridge 60 without urging the developing cartridge 60.

Referring back to FIG. 4, the cam 150 and the cam follower 170 are arranged to correspond to each of the first, second, third, fourth developing cartridges 60Y, 60M, 60C, 60K. The cam 150 and the cam follower 170 are arranged at a widthwise outer position with respect to the first lateral wall 910 on the left. In other words, the cam 150 and the cam follower 170 are arranged at a leftward position with respect to the first lateral wall 910. The cam 150 and the cam follower 170 will be described further below.

At upper positions with respect to the first lateral wall 910 and the second lateral wall 920 in the supporting member 90, arranged are contact portions 94. Each contact portion 94 may contact a slider member 64, which will be described further below. The contact portion 94 includes a roller, and while the first, second, third, and fourth photosensitive drums 50Y, 50M, 50C, 50K align along the first direction, and the axial direction of the photosensitive drum 50 extends in the second direction, the roller in the contact portion 94 may rotate about an axis extending along a third direction, e.g., vertical direction, which extends orthogonally to the first direction and to the second direction.

The supporting member 90 includes pressing members 95 for the first, second, third, and fourth developing cartridges 60Y, 60M, 60C, 60K. In particular, two (2) pressing members 95 may be provided for each of the first, second, third, and fourth developing cartridges 60Y, 60M, 60C, 60K. The pressing members 95 are arranged at one and the other ends of the corresponding developing cartridge 60 in the axial direction of the photosensitive drum 50. The pressing members 95 are urged rearward by springs 95A (see FIGS. 6A-6B). When the developing cartridge 60 is attached to the supporting member 90, the pressing members 95 may press protrusions 63D in the developing cartridge 60 to urge the developing roller 61 against the photosensitive drum 50.

Figure 5A:
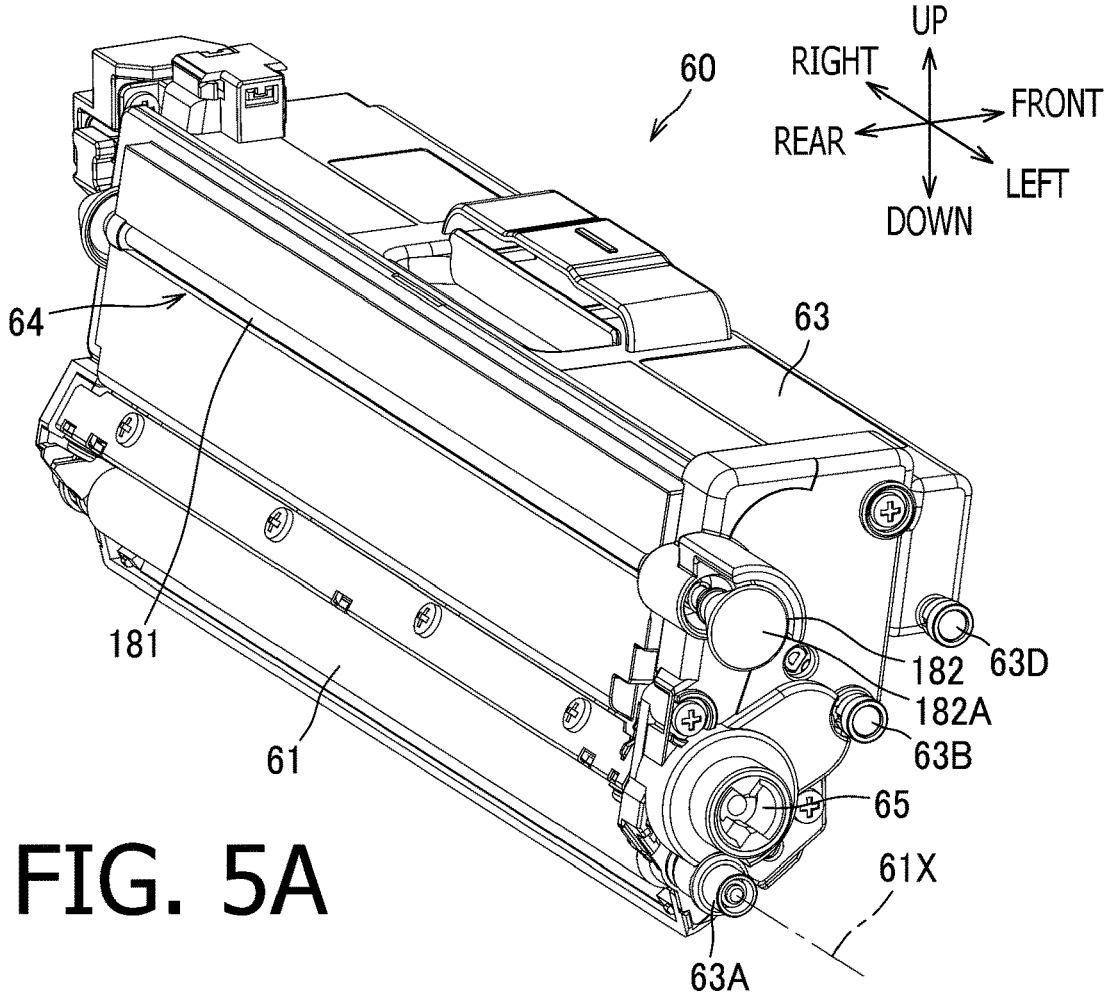
FIG. 5A is a perspective view of a developing cartridge for the image forming apparatus according to the embodiment of the present disclosure.
Figure 5B:
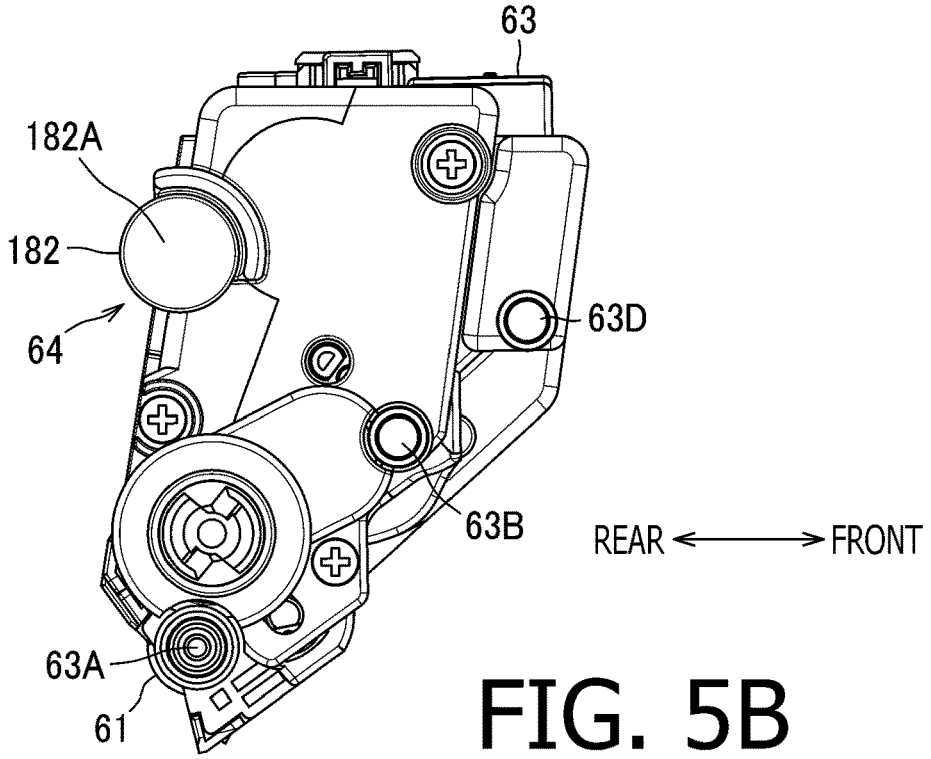
FIG. 5B is a side view of the developing cartridge for the image forming apparatus according to the embodiment of the present disclosure.

The developing cartridge 60 as shown in FIGS. 5A-5B, which is any one of the first, second, third, and fourth developing cartridges 60Y, 60M, 60C, 60K, includes a case 63 to contain toner, a slider member 64, and a coupling 65.

The case 63 has a first protrusive portion 63A and a second protrusive portion 63B, which protrude in the rotation-axis direction, on one sideward face, e.g., a leftward face, thereof. The first protrusive portion 63A is arranged coaxially with the rotation axis 61X of the developing roller 61 and protrudes in the rotation-axis direction. The second protrusive portion 63B is arranged at a position apart from the first protrusive portion 63A for a predetermined distance. The second protrusive portion 63B is arranged at an upper position with respect to the first protrusive portion 63A. The first protrusive portion 63A and the second protrusive portion 63B are rollers, which are rotatable about axes extending in parallel with the rotation-axis direction. Although not shown in the drawings, on the other sideward face, a rightward face, of the case 63 in the widthwise direction, arranged are a first protrusive portion and a second protrusive portion, which are in the same forms as the first protrusive portion 63A and the second protrusive portion 63B, respectively, at widthwise symmetrical positions.

The case 63 includes a protrusion 63D to be pressed by the pressing member 95 at a frontward position on each sideward face thereof. Thus, the protrusions 63D are arranged at end faces of the case 63 in the rotation-axis direction.

The coupling 65 may engage with a coupling shaft 119, which will be described further below, so that a rotation-driving force may be input from the coupling shaft 119 to the coupling 65.

The slider member 64 is slidable to move in the rotation-axis direction with respect to the case 63. The slider member 64 may be pressed by the cam follower 170 to slidably move in the rotation-axis direction.

As shown in FIGS. 6A-6B, the slider member 64 includes a shaft 181, a first contact member 182, and a second contact member 183. The first contact member 182 is fixed to one end, e.g., a leftward end, of the shaft 181, and the second contact member 183 is fixed to the other end, e.g., a rightward end, of the shaft 181.

The shaft 181 is arranged to extend through the case 63 via holes, which are formed in the rotation-axis direction in the case 63, to be slidably supported by the case 63.

The first contact member 182 includes a pressing face 182A, which is an end face of the first contact member 182 in the rotation-axis direction, and an oblique face 182B, which inclines with respect to the rotation-axis direction. The pressing face 182A is a face to be pressed by the cam follower 170. The oblique face 182B may, when the slider member 64 is pressed by the cam follower 170 in the rotation-axis direction, contact the contact portion 94 on the left in the supporting member 90 and urge the developing cartridge 60 in a direction parallel to the sheet-moving direction to move the developing cartridge 60 (see FIG. 6B). The oblique face 182B faces rear-rightward obliquely so that a surface position thereof shifts frontward, in a direction from the photosensitive drum 50 toward the corresponding developing roller 61, as the oblique face 182B extends from a leftward end to a rightward end, at which the first contact member 182 is connected to the shaft 181. In other words, a leftward part of the oblique face 182B is closer to the rear, and a rightward part of the oblique face 182B is closer to the front.

The second contact member 183 includes an oblique face 183B, which inclines similarly to the oblique face 182B of the first contact member 182. The oblique face 183B may, when the slider member 64 is pressed by the cam follower 170 in the rotation-axis direction, contact the contact portion 94 on the right in the supporting member 90 and urge the developing cartridge 60 in the direction parallel to the sheet-moving direction to move the developing cartridge 60 (see FIG. 6B), in the same manner as the oblique face 182B.

At a position between the first contact member 182 and the case 63, arranged is a spring 184, which urges the slider member 64 toward one side, e.g., leftward, in the rotation-axis direction. The spring 184 may be a compressed coil spring arranged to coil around an outer periphery of the shaft 181.

Figure 7:
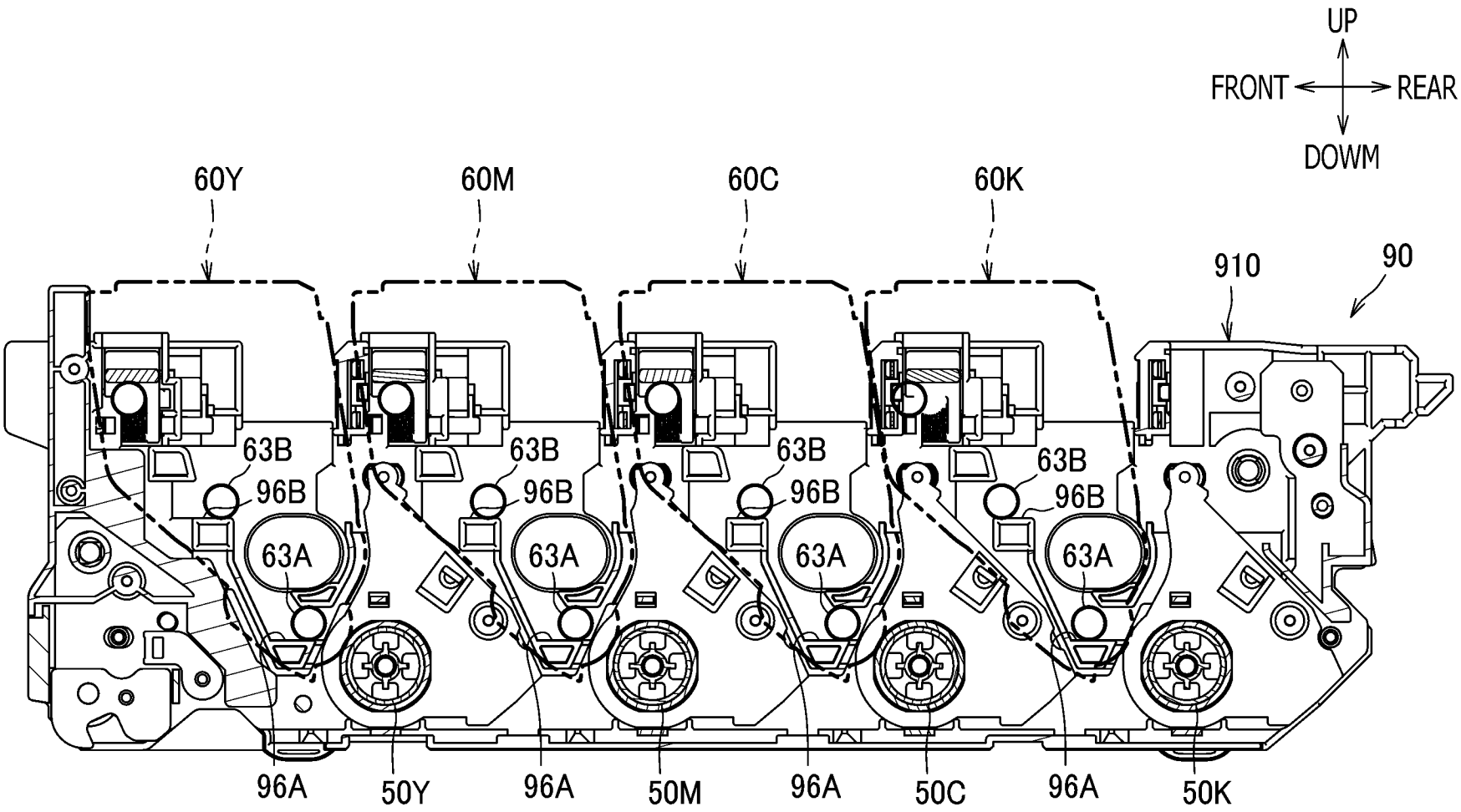
FIG. 7 is an inner-side view of a lateral wall in the supporting member in the image forming apparatus according to the embodiment of the present disclosure.

As shown in FIG. 7, the supporting member 90 has a first supporting face 96A and a second supporting face 96B on an inner side of the first lateral wall 910. The first supporting face 96A and the second supporting face 96B may support the first protrusive portion 63A and the second protrusive portion 63B of the case 63, respectively, from below when the developing roller 61 moves from the contacting position to the separated position. The first supporting face 96A and the second supporting face 96B extend in the sheet-moving direction. The first supporting face 96A is arranged to support the first protrusive portion 63A. The first supporting face 96A may guide the developing roller 61 and locate the developing roller 61 at a predetermined position when the developing cartridge 60 is being attached to the supporting member 90. The second supporting face 96B is arranged to support the second protrusive portion 63B at an upper position with respect to the first supporting face 96A. Although not shown in the drawings, the supporting member 90 has a first supporting face and a second supporting face, which are in symmetrical forms as the first supporting face 96A and the second supporting face 96B, respectively, at positions on an inner side of the side of the second lateral wall 920.

When the developing roller 61 is located at the contacting position, in which the developing roller 61 contacts the corresponding photosensitive drum 50, as seen in the first developing cartridge 60Y, the second developing cartridge 60M, and the third developing cartridge 60C shown in FIG. 7, the first protrusive portion 63A is located at a rearward position on the first supporting face 96A. On the other hand, when the developing roller 61 is located at the separated position, in which the developing roller 61 is separated from the corresponding photosensitive drum 50, as seen in the fourth developing cartridge 60K, the first protrusive portion 63A is located at a frontward position on the first supporting face 96A. Thus, when the developing roller 61 is moved from the contacting position to the separated position, the separator 5 may move the developing roller 61 in a direction from a position on a downstream side to a position on an upstream side along the sheet-moving direction.

As shown in FIGS. 13A-13B, the cam 150 includes a disk portion 151, a gear portion 150G, an edge cam 152, and a clutch-controlling cam 153. The cam 150 may move the corresponding developing roller 61 between the contacting position and the separated position by rotating.

Figure 10:
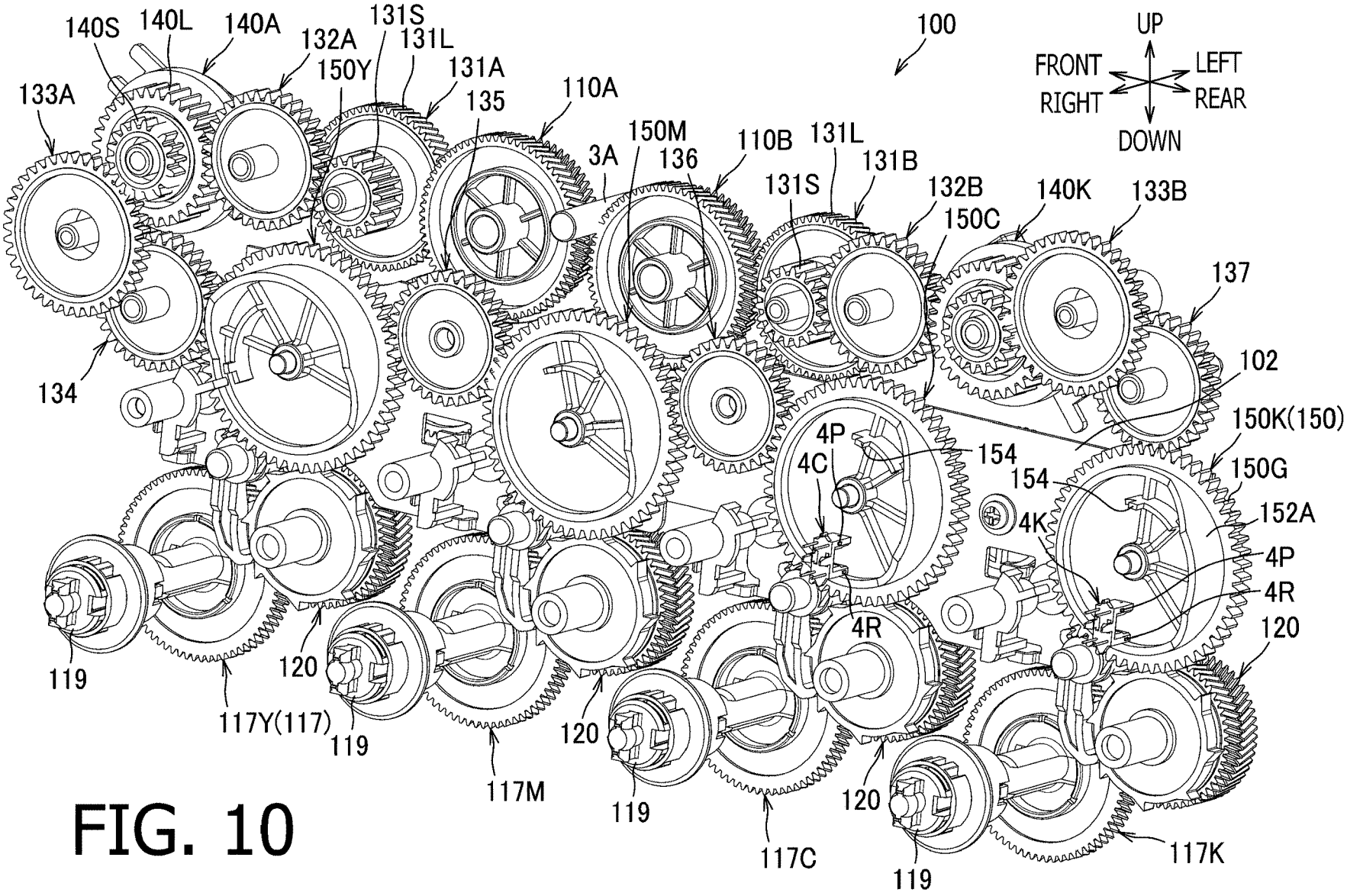
FIG. 10 is a perspective view of the driving-force transmitter in the image forming apparatus according to the embodiment of the present disclosure from an upper-right viewpoint.

The disk portion 151 has an approximate shape of a disk and is rotatably supported by a supporting plate 102 (see FIG. 10). The gear portion 150G is formed on an outer periphery of the disk portion 151. The edge cam 152 includes the first cam portion 152A, which forms a part of the moving mechanism 5 for the developing roller 61 and protrudes from the disk portion 151. The edge cam 152 includes a cam face 152F at an end in the rotation-axis direction thereof. The cam face 152F includes a first retainer face F1, a second retainer face F2, a first guide face F3, and a second guide face F4. The first retainer face F1 may retain the cam follower 170 at the standby position. The second retainer face F2 may retain the cam follower 170 at the operable position. The first guide face F3 connects the first retainer face F1 with the second retainer face F2 and inclines with respect to the first retainer face F1. The first guide face F3 may guide the cam follower 170 from the first retainer face F1 to the second retainer face F2 as the cam 150 rotates. The second guide face F4 connects the second retainer face F2 with the first retainer face F1 and inclines with respect to the first retainer face F1. The second guide face F4 may guide the cam follower 170 from the second retainer face F2 to the first retainer face F1 as the cam 150 rotates.

The clutch-controlling cam 153 works in cooperation with a lever 160 to switch transmission to or disconnection from the clutch 150. The clutch-controlling cam 153 includes a basal round portion 153A, which forms a partial cylindrical form, and a second cam portion 153B, which protrudes from the basal round portion 153A in a diametrical direction of the cam 150. The clutch-controlling cam 153 is fanned integrally with the disk portion 151. Therefore, the second cam portion 153B rotates synchronously with the cam 150.

The cam follower 170 includes a slidable shaft 171 and a contact portion 172. The slidable shaft 171 is slidably supported by a shaft, which is fixed to the casing 10 but is not shown, to slide in the rotation-axis direction. The slidable shaft 171 is urged by a spring 173 in a direction such that the contact portion 172 tends to contact the cam face 152F of the cam 150. Therefore, the cam follower 170 is urged toward the standby position. The spring 173 is a tension coil spring, one end of which is hooked to the slidable shaft 171, and the other end of which is hooked to a spring hook being arranged in the casing 10 but not shown. The contact portion 172 extends from the slidable shaft 171. An end face of the contact portion 172 at one end in the rotation-axis direction faces the cam face 152 and contacts the cam face 152F.

As shown in FIG. 10, the cams 150Y, 150M, 150C, 150K are in substantially a same configuration except that a circumferential length of the first cam portion 152A along a rotating direction is greater in the cam 150Y alone than a circumferential length of the other first cam portion 152A in the cams 150M, 150C, 150K. The cams 150C, 150K each has a detectable portion 154, which protrudes from the disk portion 151 in the rotation-axis direction. Meanwhile, in the casing 10, arranged are separation sensors 4C, 4K for cyan and black. The separation sensors 4C, 4K are phase sensors to detect phases of the cams 150C, 150K, respectively. The separation sensors 4C, 4K may output separation signals when the cams 150C, 150K are in predetermined phase range, in which the third and fourth developing rollers 61C, 61K are at the separated positions. The separation sensors 4C, 4K output no separation signal when the cams 150C, 150K are not in the predetermined phase range. In the present embodiment, for a reason of convenience, the separation sensor(s) 4C, 4K outputting the separation signal may be expressed as "the separation sensor(s) 4C, 4K is/are ON." Moreover, the separation signal may be called as an ON signal. Meanwhile, the separation sensors 4C, 4K outputting no separation signal may be expressed as "the separation sensors 4C, 4K output OFF signals." A voltage required in the phase sensors 4C, 4K to output the separation signal may either be higher or lower than a voltage in the phase sensors 4C, 4K not outputting the separation signal.

The separation sensors 4C, 4K each includes an emitter 4P to emit light and a receiver 4R receivable of the light emitted from the emitter 4P. When the detectable portion 154 is at a position between the emitter 4P and the receiver 4R to interrupt the light from the emitter 4P, the receiver 4R may not receive the light from the emitter 4P, and the separation sensor 4C, 4K may output ON signals to the controller 2. On the other hand, when the detectable portion 154 is displaced from the position between the emitter 4P and the receiver 4R, the receiver 4R may receive the light from the emitter 4P, the separation sensor 4C, 4K may output OFF signals to the controller 2. It may be noted that the cams 150Y, 150M as well has the same formation as the detectable portion 154; however, neither the cam 150Y nor the cam 150M is provided with a separation sensor. Therefore, the formation similar to the detectable portion 154 in the cam 150Y or the cam 150M may not serve as a detectable portion.

Referring back to FIG. 1, the conveyer 70 is arranged between the sheet tray 21 and the photosensitive drum 50. The conveyer 70 includes a driving roller 71, a driven roller 72, a conveyer belt 73 being an endless belt, and four (4) transfer rollers 74. The conveyer belt 73 is strained around the driving roller 71 and the driven roller 72, with an upper outer surface thereof facing the photosensitive drum 50. The transfer rollers 74 are arranged inside the conveyer belt 73 to nip the conveyer belt 73 in cooperation with the first, second, third, and fourth photosensitive drums 50Y, 50M, 50C, 50K. The conveyer 70 may convey the sheet S placed on the upper outer surface thereof by moving the conveyer belt 73 so that the toner images on the first, second, third, and fourth photosensitive drums 50Y, 50M, 50C, 50K may be transferred onto the sheet S.

The fuser 80 is arranged at a rearward position with respect to the photosensitive drum 50 and the conveyer 70. The fuser 80 includes a heat roller 81 and a pressurizer roller 82 arranged to face the heat roller 81. At a position downstream from the fuser 80 in the sheet-conveying direction, arranged is an ejection sensor 28D to detect the sheet S passing thereby. At an upper position with respect to the fuser 80, arranged is a conveyer roller 15, and at an upper position with respect to the conveyer roller 15, arranged is an ejection roller 16.

In the image forming device 30 configured as above, the surface of the photosensitive drum 50 may be charged evenly by the charger and selectively exposed to the light emitted from the exposure device 40. Thereby, electrostatic latent images based on image data may be formed on the surface of the photosensitive drum 50.

Meanwhile, the toner in the case 63 may be supplied to the surface of the developing roller 61, and when the developing roller 61 contacts the corresponding photosensitive drum 50, the toner may be supplied to the electrostatic latent image formed on the surface of the photosensitive drum 50. Thus, the toner image may be formed on the photosensitive drum 50.

When the sheet S on the conveyer belt 73 passes through the position between the photosensitive drum 50 and the transfer roller 74, the toner image formed on the photosensitive drum 50 may be transferred onto the sheet S. Further, as the sheet S is conveyed to pass through the position between the heat roller 81 and the pressurizer roller 82, the toner images transferred to the sheet S may be fused to the sheet S.

The sheet S ejected from the fuser 80 may be conveyed by the conveyer roller 15 and the ejection roller 16 to rest on an ejection tray 13 formed on an upper face of the casing 10.

Next, described in the following paragraphs will be a configuration to drive or stop rotation of the developing roller 61 and a configuration to move the developing roller 61 to contact or separate from the photosensitive drum 50.

Figure 8:
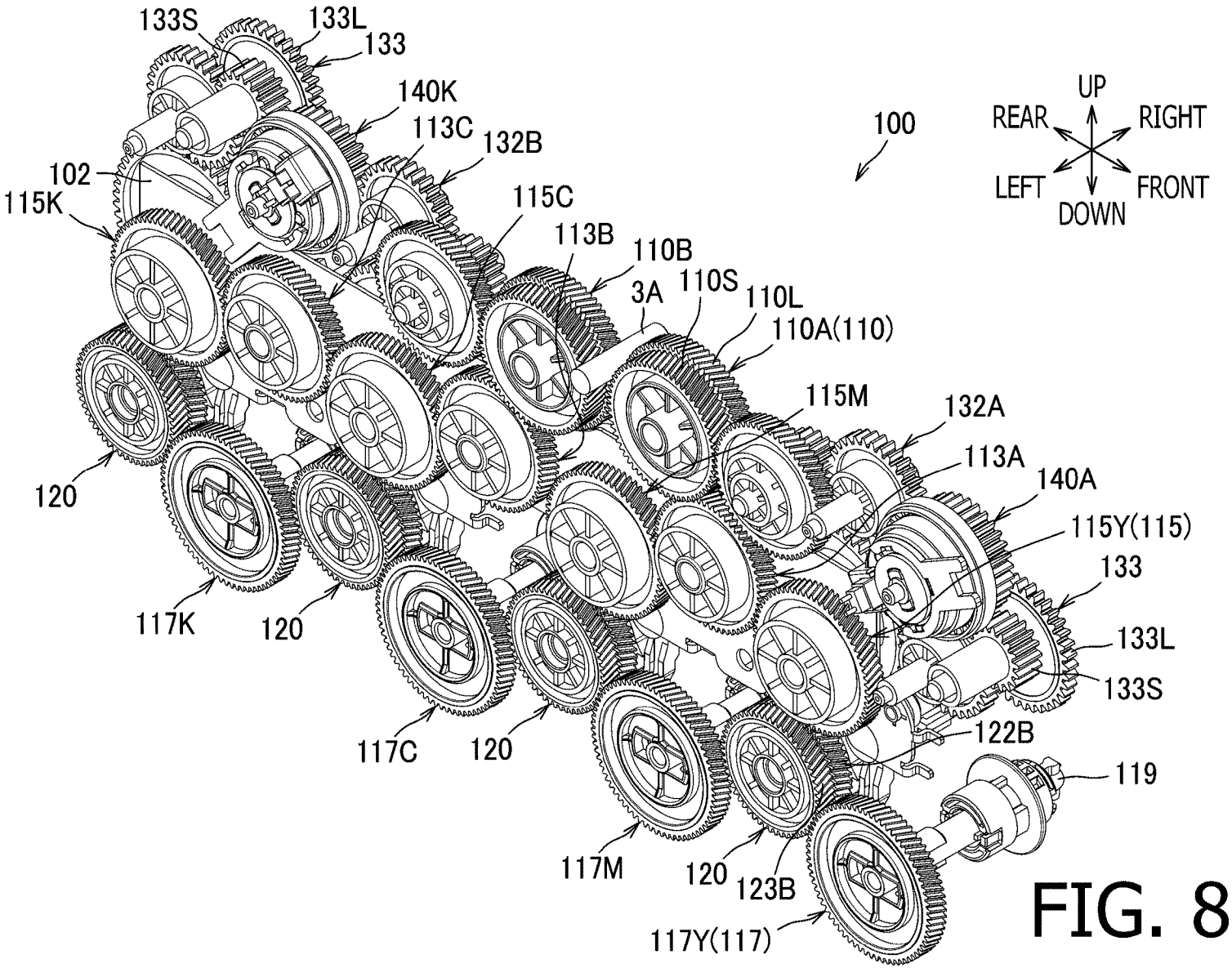
FIG. 8 is a perspective view of a driving-force transmitter in the image forming apparatus according to the embodiment of the present disclosure from an upper-left viewpoint.
Figure 9:
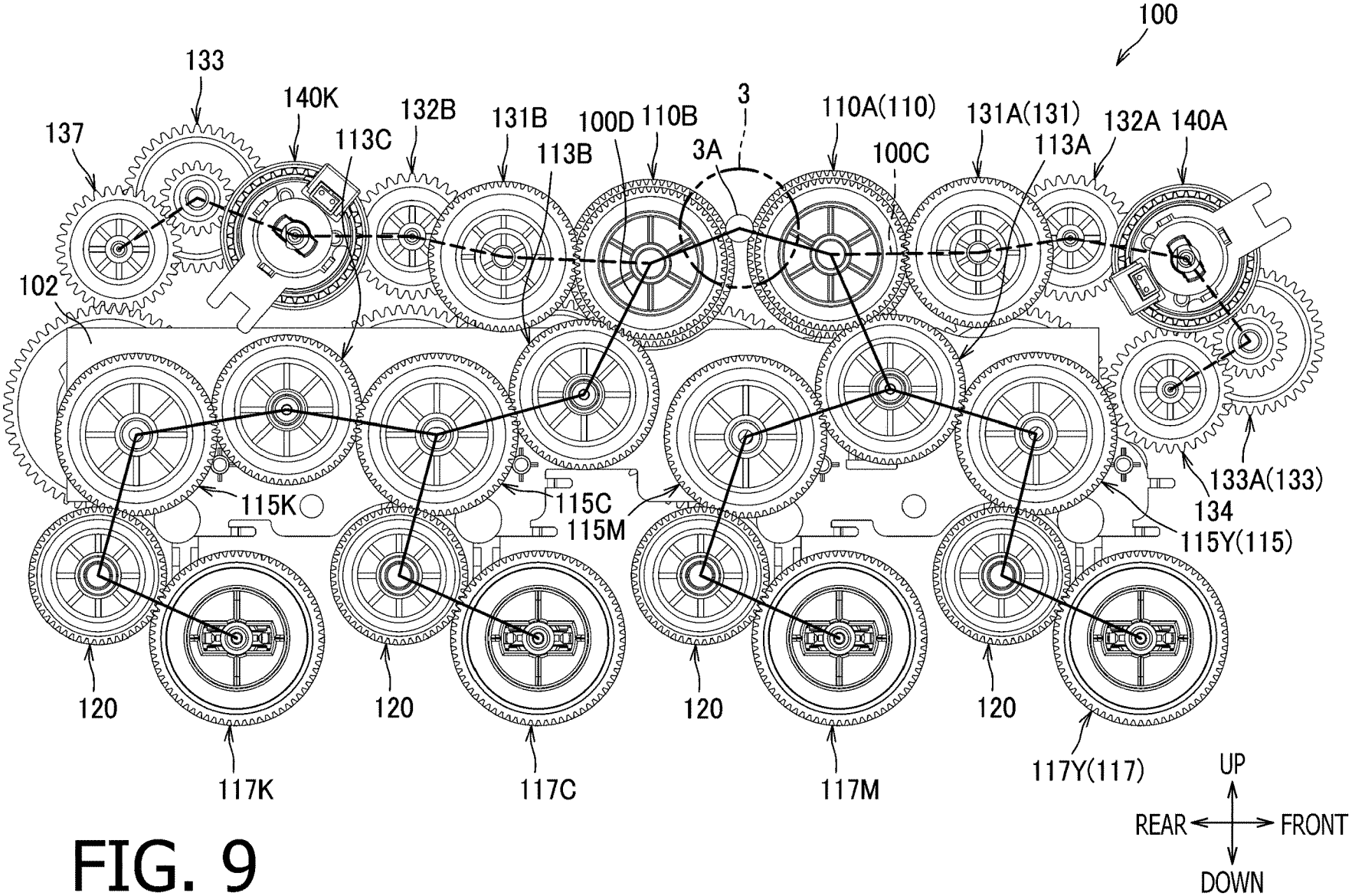
FIG. 9 is a side view of the driving-force transmitter in the image forming apparatus according to the embodiment of the present disclosure viewed from left toward right along an axial direction.

As shown in FIGS. 8-9, the image forming apparatus 1 includes a motor 3 and a driving-force transmitter 100, which may transmit a driving force from the motor 3 to the developing roller 61. The cam 150 being a part of the moving mechanism 5 is mechanically connected with the driving-force transmitter 100. The driving-force transmitter 100 is arranged not to transmit the driving force to the developing roller 61 when the developing roller 61 is at the separated position.

Figure 11:
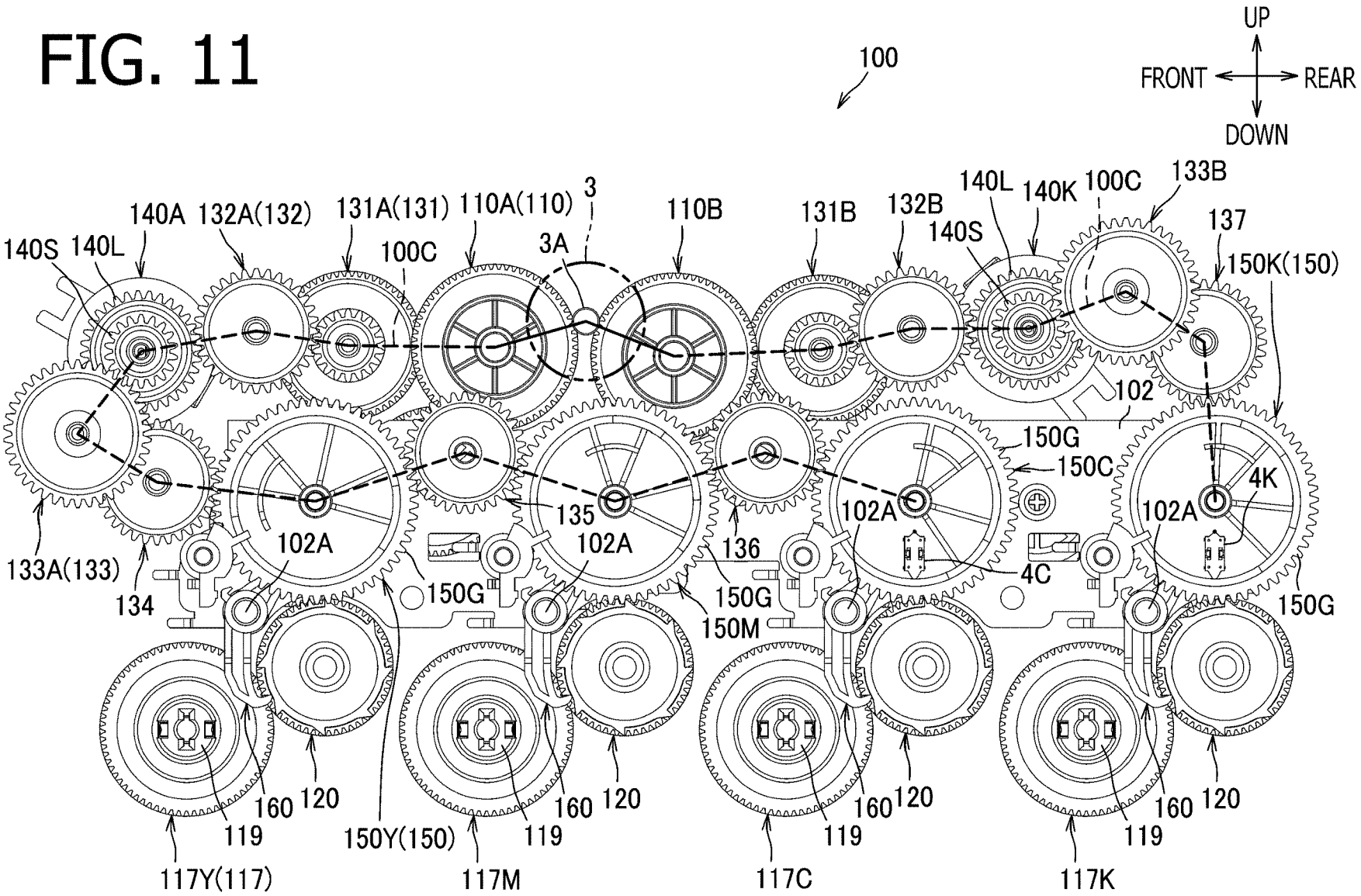
FIG. 11 is a side view of the driving-force transmitter in the image forming apparatus according to the embodiment of the present disclosure viewed from right toward left along the axial direction.

The driving-force transmitter 100 includes, as shown in FIG. 9, a driving-force transmitter gear train 100D, which may transmit the driving force from the motor 3 to the developing roller 61, and is mechanically connected with a driving-force controlling gear train 100C, which may control transmission of the driving force from the driving-force transmitter gear train 100D. In FIGS. 9 and 11, intermeshing transmitting flows through gears in the driving-force transmitter gear train 100D are indicated in thicker solid lines, and intermeshing transmitting flows through gears in the driving-force controlling gear train 100C are indicated in thicker broken lines.

The driving-force transmitter gear train 100D includes first idle gears 110, second idle gears 113, third idle gears 115, clutches 120, and coupling gears 117. The first idle gears 100 include two (2) first idle gears 110A, 110B; the second idle gears 113 include three (3) second idle gears 113A, 113B, 113C; the third idle gears 115 include four (4) third idle gears 115Y, 115M, 115C, 115K; the clutches 120 includes four (4) clutches 120; and the coupling gears 117 include four (4) coupling gears 117Y 117M, 117C, 117K. The gears forming the driving-force transmitter gear train 110D are supported by either the supporting plate 102 or a frame, which is not shown, and may rotate about rotation axes parallel to the rotation axis of the photosensitive drum 50.

The motor 3 includes an output shaft 3A, which may rotate when the motor 3 is active. To the output shaft 3A, attached is a gear, which is not shown.

As shown in FIG. 8, each first idle gear 110 is a two-wheeler gear having a larger-diameter gear 110L and a smaller-diameter gear 110S. A quantity of teeth in the smaller-diameter gear 110S is smaller than a quantity of teeth in the larger-diameter gear 110L. The larger-diameter gear 110L and the smaller-diameter gear 110S rotate integrally. The first idle gear 110A is arranged at a frontward position with respect to the output shaft 3A, and the first idle gear 110B is arranged at a rearward position with respect to the output shaft 3A. The smaller-diameter gears 110S in the first idle gears 110A, 110B mesh with the output shaft 3A.

As shown in FIG. 9, on the frontward side with respect to the output shaft 3A, the smaller-diameter gear 110S in the first idle gear 110A meshes with the second idle gear 113A. On the rearward side of the output shaft 3A, the smaller-diameter gear 110S in the first idle gear 110B meshes with the second idle gear 113B.

The third idle gears 115Y, 115M, 115C, 115K are provided to correspond to the colors of yellow, magenta, cyan, and black, respectively, and arranged in this recited order from front to rear. In other words, the third idle gear 115Y for yellow is at a most frontward position among the third idle gears 115Y, 115M, 115C, 115K, and the third idle gear 115K for black is at a most rearward position among the third idle gears 115Y, 115M, 115C, 115K. The third idle gears 115Y, 115M mesh with the second idle gear 113A. The third idle gear 115C meshes with the second idle gear 113B. The third idle gears 115C, 115K mesh with the second idle gear 113C. Therefore, the third idle gear 115K may receive the driving force from the third idle gear 115C through the second idle gear 113C.

The clutches 120 are in a same configuration. The clutches 120 each meshes with one of the third idle gears 115Y, 115M, 115C, 115K to receive the driving force from the third idle gears 115Y, 115M, 115C, 115K. The clutches 120 will be described further below.

The coupling gears 117 each meshes with one of the clutches 120. Each coupling gear 117 includes a coupling shaft 119 (see FIG. 8), which is rotatable integrally with the coupling gear 117. The coupling shaft 119 is movable in a direction of an axis thereof in cooperation with opening/closing motions of the front cover 11. The coupling shaft 119 may engage with a coupling 65 (see FIG. 5A) in the developing cartridge 60 when the front cover 11 is closed.

With the driving-force transmitter gear train 110D, the coupling gear 117Y for yellow may receive the driving force from the motor 3 through the first idle gear 110A, the second idle gear 113A, the third idle gear 115Y, and the clutch 120. The coupling gear 117M for magenta may receive the driving force from the motor 3 through the first idle gear 110A, the second idle gear 113A, the third idle gear 115M, and the clutch 120. The coupling gear 117C for cyan may receive the driving force from the motor 3 through the first idle gear 110B, the second idle gear 113B, the third idle gear 115C, and the clutch 120. The coupling gear 117K for black may receive the driving force from the motor 3 through the first idle gear 110B, the second idle gear 113B, the third idle gear 115C, the second idle gear 113C, the third idle gear 115K, and the clutch 120.

As shown in FIGS. 10 and 11, the driving-force controller gear train 110C includes fourth idle gears 131, fifth idle gears 132, a YMC clutch 140A, a K clutch 140K, sixth idle gears 133, a seventh idle gear 134, an eighth idle gear 135, a ninth idle gear 136, a tenth idle gear 137, and the cam 150 including the cams 150Y, 150M, 150C, 150K described earlier. The fourth idle gears 131 include two (2) fourth idle gears 131A, 131B; the fifth idle gears 132 include two (2) fifth idle gears 132A, 132B; the sixth idle gears 133 include two (2) idle gears 133A, 133B. The gears forming the driving-force controller gear train 110C are supported by either the supporting plate 102 or a frame, which is not shown, and may rotate about rotation axes parallel to the rotation axis of the photosensitive drum 50.

Each fourth idle gear 131 is a two-wheeler gear having a larger-diameter gear 131L and a smaller-diameter gear 131S (see FIG. 10). A quantity of teeth in the smaller-diameter gear 131S is smaller than a quantity of teeth in the larger-diameter gear 131L. The larger-diameter gear 131L and the smaller-diameter gear 131S rotate integrally. The fourth idle gear 131A is arranged at a frontward position with respect to the first idle gear 110A, and the fourth idle gear 131B is arranged at a rearward position with respect to the first idle gear 110B. The larger-diameter gears 131L in the fourth idle gears 131A, 131B mesh with the smaller-diameter gears 110S in the first idle gears 110A, 110B, respectively.

The fifth idle gear 132A is arranged at a frontward position with respect to the fourth idle gear 131A, and the fifth idle gear 132B is arranged at a rearward position with respect to the fourth idle gear 131B. The fifth idle gears 132A, 132B mesh with the smaller-diameter gears 131S in the fourth idle gears 131A, 131B, respectively.

The YMC clutch 140A may switch transmission and disconnection of the driving-force controller gear train 110C, which forms the transmission flow to transmit the driving force from the motor 3 to the cams 150Y, 150M, 150C. In other words, the YMC clutch 140A may switch state of the cams 150Y, 150M, 150C between rotating and stationary. The YMC clutch 140A includes a larger-diameter gear 140L and a smaller-diameter gear 140S. A quantity of teeth in the smaller-diameter gear 140S is smaller than a quantity of teeth in the larger-diameter gear 140L. The YMC clutch 140A is arranged at a frontward position with respect to the fifth idle gear 132A, with the larger-diameter gear 140L meshing with the fifth idle gear 132A. The YMC clutch 140A may be, for example, an electromagnetic clutch, in which the larger-diameter gear 140L and the smaller-diameter gear 140S may rotate integrally when the YMC clutch 140A is powered on, or activated; and when the YMC clutch 140A is powered off, or deactivated, the larger-diameter gear 140L may idle so that the smaller-diameter gear 140S may stay stationary.

The K clutch 140K is in the configuration similar to the YMC clutch 140A. Therefore, the K clutch 140K may switch transmission and disconnection of the driving-force controller gear train 110C, which forms the transmission flow to transmit the driving force from the motor 3 to the cam 150K. In other words, the K clutch 140K may switch state of the cam 150K between rotating and stationary. The K clutch 140K includes a larger-diameter gear 140L and a smaller-diameter gear 140S. A quantity of teeth in the smaller-diameter gear 140S is smaller than a quantity of teeth in the larger-diameter gear 140L. The K clutch 140A is arranged at a rearward position with respect to the fifth idle gear 132B, with the larger-diameter gear 140L meshing with the fifth idle gear 132B.

Each sixth idle gear 133 is a two-wheeler gear having a larger-diameter gear 133L and a smaller-diameter gear 133S (see FIG. 8). A quantity of teeth in the smaller-diameter gear 133S is smaller than a quantity of teeth in the larger-diameter gear 133L. The larger-diameter gear 133L and the smaller-diameter gear 133S rotate integrally. The fourth idle gear 133A is arranged at a frontward position with respect to the YMC clutch 140A, and the fourth idle gear 133E is arranged at a rearward position with respect to the K clutch 140K. The larger-diameter gears 133L in the sixth idle gears 133A, 133B mesh with the smaller-diameter gears 140S in the YMC clutch 140A and the K clutch 140K, respectively.

The seventh idle gear 134 is arranged between the sixth idle gear 133A and the cam 150Y. The seventh idle gear 134 meshes with the smaller-diameter gear 133S (see FIG. 8) in the sixth idle gear 133A and the gear portion 150G in the cam 150Y.

The eighth idle gear 135 is arranged between the cam 150Y and the cam 150M. The eighth idle gear 135 meshes with the gear portion 150G in the cam 150Y and the gear portion 150G in the cam 150M.

The ninth idle gear 136 is arranged between the cam 150M and the cam 150C. The ninth idle gear 136 meshes with the gear portion 150G in the cam 150M and the gear portion 150G in the cam 150C.

The tenth idle gear 137 is arranged between the sixth idle gear 133B and the cam 150K. The tenth idle gear 137 meshes with the smaller-diameter gear 133S in the sixth idle gear 133B (see FIG. 8) and the gear portion 150G in the cam 150K.

With the driving-force controlling gear train 110C, the cam 150Y for yellow may receive the driving force from the motor 3 through the first idle gear 110A, the fourth idle gear 131A, the fifth idle gear 132A, the YMC clutch 140A, the sixth idle gear 133A, and the seventh idle gear 134. The cam 150M for magenta may receive the driving force from the cam 150Y for yellow through the eighth idle gear 135. The cam 150C for cyan may receive the driving force from the cam 150M for magenta through the ninth idle gear 136. The cams 150Y, 150M, 150C may synchronously rotate when the YMC clutch 140A is activated and stop rotating by when the YMC clutch 140A is deactivated.

The cam 150K for black, on the other hand, may receive the driving force from the motor 3 through the first idle gear 110B, the fourth idle gear 131B, the fifth idle gear 132B, the K clutch 140K, the sixth idle gear 133B, and the tenth idle gear 137. The cam 150K may rotate when the K clutch 150K is activated and stop rotating when the K clutch 140K is deactivated.

Figure 12A:
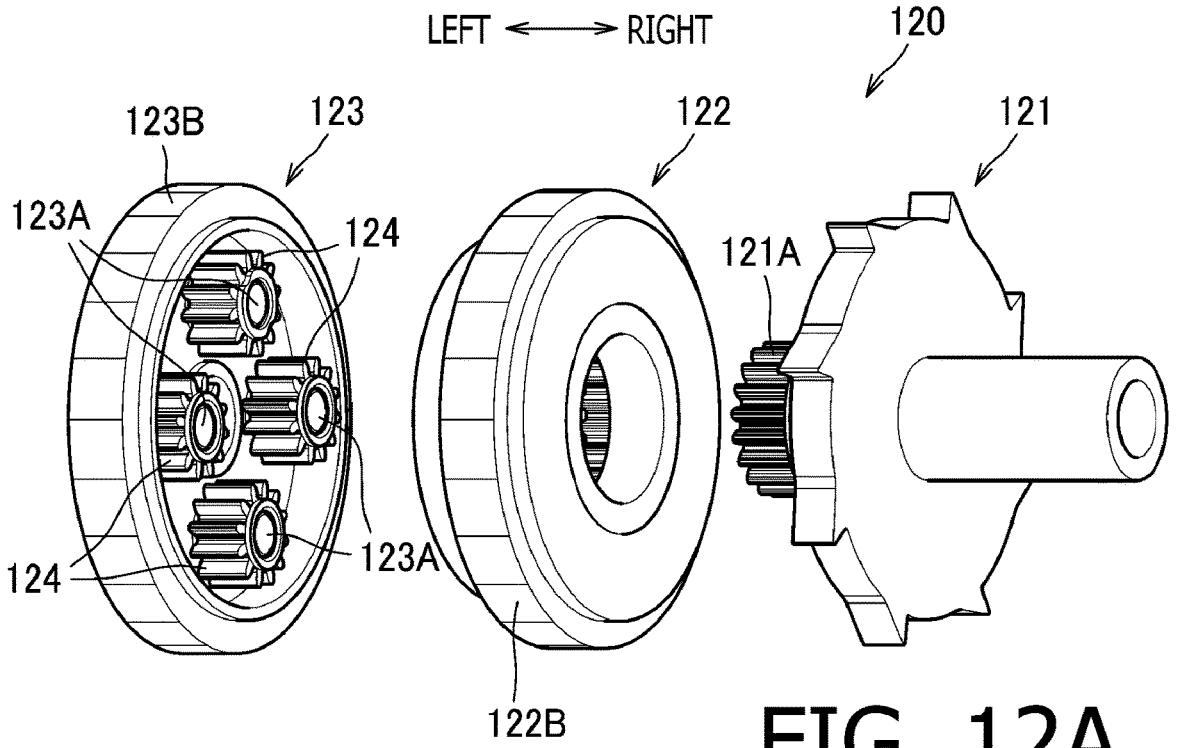
FIGS. 12A and 12B are exploded views of a clutch in the image forming apparatus according to the embodiment of the present disclosure, viewed from a side of a sun gear and a side of a carrier, respectively.
Figure 12B:
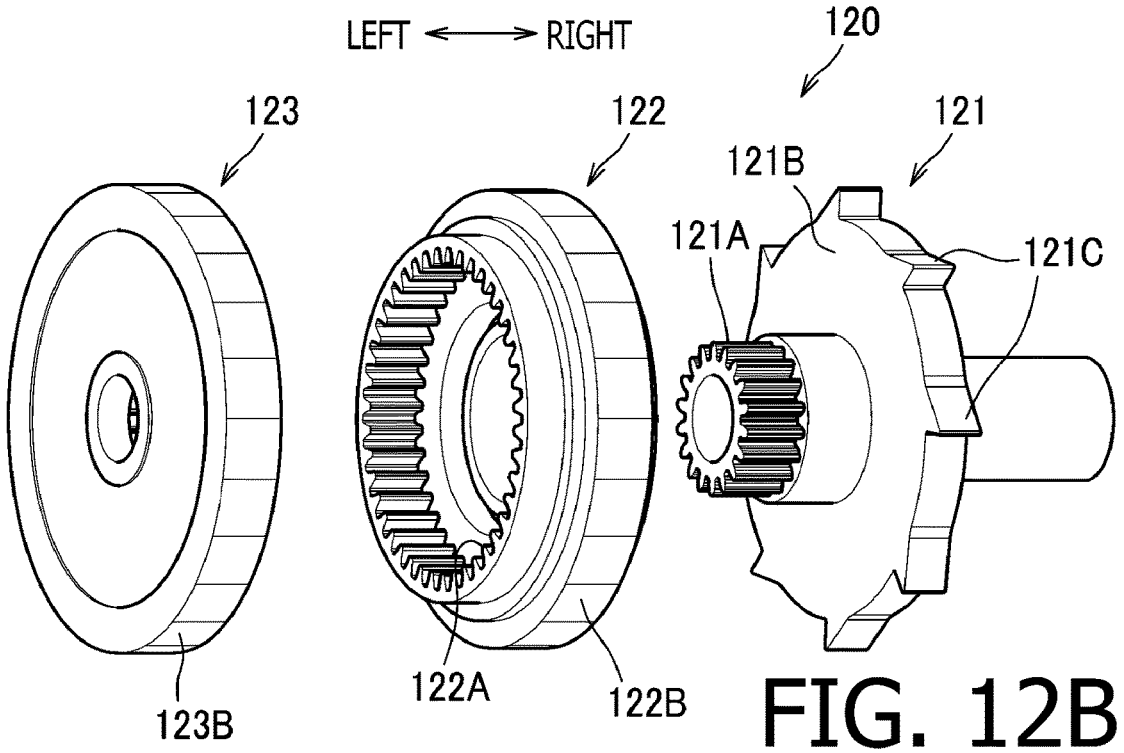

In the following paragraphs, described will be the detailed configuration and movements of the clutch 120. As shown in FIGS. 12A-12B, each clutch 120 includes a planetary gear assembly. The clutch 120 is switchable between a transmittable condition, in which the clutch 120 may transmit the driving force from the motor 3 to the developing roller 61, and a discontinuing condition, in which the clutch 120 may disconnect the driving force from the motor 3 not to be transmitted to the developing roller 61. The clutch 120 includes a sun gear 121, which is rotatable about an axis, a ring gear 122, a carrier 123, and planetary gears 124 supported by the carrier 123.

The sun gear 121 includes a disk portion 121B, which is rotatable integrally with the gear portion 121A, and claw portions 121C, which are arranged on an outer circumference of the disk portion 121. The claw portions 121C each has a pointed end, which leans to one side in a rotating direction of the sun gear 121. The ring gear 122 includes an inner gear 122A arranged on an inner circumferential surface and an input gear 122B arranged on an outer circumferential surface.

The carrier 123 includes four (4) shaft portions 123A, which support the planetary gears 124 rotatably. The carrier 123 includes an output gear 123B arranged on an outer circumferential surface thereof.

The planetary gears 124 include four (4) planetary gears 124, each of which is supported by one of the shaft portions 123A in the carrier 123. The planetary gears 124 mesh with gear portion 121A of the sun gear 121 and with the inner gear 122A in the ring gear 122.

In the clutch 120, the input gear 122B meshes with the third idle gear 115, and the output gear 123B meshes with the coupling gear 117 (see FIG. 8). In this arrangement, when the sun gear 121 is restrained from rotating, the clutch 120 is in the transmittable condition, in which the driving force input to the input gear 122B is transmittable to the output gear 123B. On the other hand, when the sun gear 121 is allowed to rotate, the clutch 120 is in the discontinuing condition, in which the driving force input to the input gear 122B is not transmittable to the output gear 123B. When the clutch 120 is in the discontinuing condition, and the output gear 123B is under load, and when the driving force is input to the input gear 122B, the output gear 123B does not rotate so that the sun gear 121 idles.

As shown in FIG. 11, the driving-force transmitter 100 includes the lever 160. The lever 160 is swingably supported by a supporting shaft 102A, which is fixed to the supporting plate 102. The lever 160 may, in cooperation with the cam 150, engage with the sun gear 121, which is one of the elements in the planetary gear assembly, to restrict the sun gear 121 from rotating so that the clutch 120 may be placed in the transmittable condition, and may release the sun gear 121 so that the clutch 120 may be placed in the discontinuing condition.

In particular, as shown in FIG. 13A, the lever 160 includes a rotation-supporting portion 161, a first arm 162 extending from the rotation-supporting portion 161, and a second arm 163 extending from the rotation-supporting portion 161 in a direction different from the first arm 162.

The rotation-supporting portion 161 has a cylindrical shape with a hollow, in which the supporting shaft 102A of the supporting plate 102 is inserted to support the lever 160.

An end of the second arm 163 extends toward the outer circumferential surface of the disk portion 121B of the clutch 120. The lever 160 is urged by a torsion spring, which is not shown, such that the end of the second arm 163 is urged against the outer circumferential surface of the sun gear 121, or the disk portion 121B. The end of the second arm 163 forms a hook 163A. The hook 163A may engage with one of the claw portions 121C formed on the outer circumferential surface of the sun gear 121 to restrict the sun gear 121 from rotating.

The lever 160 may contact the second cam portion 153B at an end portion 162A of the first arm 162. The lever 160 is movable between an engaging position, in which the end portion 162A of the first aim 162 faces the basal round portion 153A while the hook 163A engages with one of the claw portions 121C in the clutch 120, and a separating position, in which the end portion 162A of the first arm 162 is pushed by the second cam portion 153B to cause the hook 163A to separate from the claw portions 121C in the sun gear 121 being one of the elements in the planetary gear assembly. The lever 160 may place the clutch 120 in the transmittable condition when the lever 160 is separated from the second cam portion 153B and located at the engaging position and may place the clutch 120 in the discontinuing condition when the lever 160 contacts the second cam portion 153B and is located at the separated position.

With reference to FIGS. 13A-13B through 17A-17B, described below will be the movements of the lever 160. It may be noted that, while the items for yellow are illustrated in FIGS. 13A-13B through 17A-17B, among the four colors of yellow, magenta, cyan, and black, the corresponding items for the other colors, i.e., magenta, cyan, and black, may act in the same manners as the items for yellow, except that the phases in the cams 150Y, 150M, 150C, 150K are different.

As shown in FIGS. 13A-13B, as the clutch-controlling cam 153 rotates, the end portion 162A of the first cam 162 tracing the second cam portion 153B may separate from the second cam portion 153B and face the basal round portion 153A. Meanwhile, the hook 163A in the second arm 163 may engage with one of the claw portions 121C in the sun gear 121 in the clutch 120 to place the lever 160 at the engaging position. As the lever 160 restricts the sun gear 121 from rotating, the clutch 120 may be placed in the transmittable condition, in which the output gear 123B is rotatable when the input gear 122B rotates. Thereby, the driving force from the motor 3 may be transmittable to the developing roller 61 through the driving-force transmitter gear train 100D, and when the motor 3 rotates, the developing roller 61 may rotate. Meanwhile, the cam follower 170 is located at a position, in which the end face of the contact portion 172 is on the first retainer face F1 of the cam face 152F. Therefore, the slidable shaft 171 is separated from the slider member 64 in the developing cartridge 60 (see FIG. 6A), and the developing roller 61 is located at the contacting position.

As the cam 150 rotates from the position shown in FIGS. 13A-13B to a position shown in FIGS. 14A-14B, the contact portion 172 of the cam follower 170 slides on the first retainer face F1 to be closer to the first guide face F3. In order to stop the cam 150Y among the four (4) cams 150 at a position, in which the first developing roller 61Y is at the contacting position, the cam 150Y may be stopped at the position as shown in FIGS. 14A-14B, in which the contact portion 172 is on the first guide face F3.

In order to separate the developing roller 61 from the photosensitive drum 50, the cam 150Y may further rotate so that the contact portion 172 may slide on the first guide face F3 and pushed by the first guide face F3 to contact the second retainer face F2, as shown in FIGS. 15A-15B. Meanwhile, the slidable shaft 171 may push the slider member 64 in the developing cartridge 60 in the rotation-axis direction. Thereby, the developing cartridge 60 may be moved frontward by a reaction force from the supporting member 90 (see FIG. 6B). The developing roller 61 may, when the contact portion 172 is at a position on the first guide face F3 closer to the second retainer face F2 rather than the first retainer face F1, start separating from the photosensitive drum 50. When the contact portion 172 is on the second retainer face F2, the developing roller 61 is maintained at the separated position.

When the developing roller 61 is at the separated position, the cam 150 may rotate further to a position, in which the end portion 162A of the arm 162 in the lever 160 may contact the second cam portion 153B, as shown in FIGS. 16A-16B. As the first arm 162 is pushed by the second cam portion 153B, the lever 160 may swing, and the hook 163A unhooked from the claw portion 121C in the sun gear 121 may move to the separating position. Therefore, the sun gear 121 in the clutch 120 may be released from the lever 160 for rotation and placed in the discontinuing condition, in which the output gear 123B is not transmittable of the driving force even when the input gear 122B rotates. Thereby, the driving force from the motor 3 may not be transmitted to the developing roller 61. In other words, even when the motor 3 rotates, merely the sun gear 121 idles, and the developing roller 61 does not rotate.

In order to place and maintain the developing roller 61 at the separated position, the cam 150 may be stopped at a position, as shown in FIGS. 16A-16B, in which the lever 160 is at the separating position. However, in order to maintain the first developing roller 61Y specifically at the separated position, the cam 150Y for yellow among the cams 150Y, 150M, 150C, 150K may be rotated further from the position shown in FIGS. 16A-16B and stopped at a position, as shown in FIGS. 17A-17B, in which the contact portion 172 is at an end of the second retainer face F2 closer to the second guide face F4 rather than the first guide face F3, e.g., a position on the second retainer face F2 most or immediately adjacent to a boundary between the second retainer face F2 and the second guide face F4.

In order to move the developing roller 61 from the separated position to the contacting position, the cam 150 may be rotated from the position shown in either FIGS. 16A-16B or FIGS. 17A-17B so that the contact portion 172 may slide on the second guide face F4 to a position, as shown in FIGS. 13A-13B, in which the contact portion 172 faces the first retainer face F1. Thereby, the slidable shaft 171 may be moved in the rotation-axis direction by the urging force of the spring 173 to separate from the slider member 64. The slider member 64 may return to the position shown in FIG. 6A, and the developing cartridge 60 may return to the position indicated by the solid lines in FIG. 1. Therefore, the developing roller 61 may contact the photosensitive drum 50. In other words, the developing roller 61 may contact the photosensitive drum 50 when the contact portion 172 passes through the position on the second guide face F4 adjacent to the second retainer face F2 (see FIG. 17B).

Accordingly, with the lever 160 located at the engaging position, in which the lever 160 faces the basal round portion 153A and engages with the sun gear 121, the clutch 120 may be placed in the transmittable condition.

Next, in the following paragraphs, described in detail will be the configuration for locating the drum unit 500 at a correct position in the casing 100. In the following description, a position of the drum unit 500 as shown in FIG. 18, in which the drum unit 500 is attached to the casing 10, and in which the first, second, third, and fourth photosensitive drums 50Y 50M, 50C, 50K are located at respective predetermined positions in the casing 10 so that image forming is performable, may be called as a stored position. Meanwhile, a user may draw the drum unit 500 outward from the casing 10 to a drawn-out position, in which the photosensitive drum 50 and the developing cartridge 60 are located outside the casing 10, in order to, for example, exchange the developing cartridges 60.

As shown in FIG. 18, when the drum unit 500 is at the stored position, the first engageable portion 911 in the first lateral wall 910 engages with the first restrictive portion 411 in the first side-frame 410, and the second engageable portion 912 in the second lateral wall 912 engages with the second restrictive portion 412 in the first side-frame 410. When the drum unit 500 is at the drawn-out position, on the other hand, the first engageable portion 911 in the first lateral wall 910 is disengaged from the first restrictive portion 411 in the first side-frame 410, and the second engageable portion 912 in the first lateral wall 910 is disengaged from the second restrictive portion 412.

As shown in FIG. 3, the first restrictive portion 411 is arranged on an inner side of the inner cover 450 that forms a part of the first side-frame 410, in particular, on a side of the inner cover 450 opposite to a side that faces toward the second side frame 420. The first restrictive portion 411 is accessible through an opening at a frontward end of the inner cover 450 from the front side, i.e., the side of the opening of the casing 11 that may be covered by the front cover 11. The second restrictive portion 412 is arranged on an inner side of the inner cover 460 that forms a part of the first side-frame 410, in particular, on a side of the inner cover 460 opposite to a side that faces toward the second side frame 420. The second restrictive portion 412 is accessible through an opening at a frontward end of the inner cover 460 from the front side.

As shown in FIG. 18, in a state where the image forming apparatus 1 is situated on a setting plane FP such as a floor or a table, and where the drum unit 500 is attached to the casing 10, a distance between the setting plane FP and the first restrictive portion 411 and a distance between the setting plane FP and the second restrictive portion 412 are equal. In other words, the first restrictive portion 411 and the second restrictive portion 412 at a same height H from the setting plane FP. Moreover, the cam followers 170 are at the same height H as the first and second restrictive portions 411, 412. In this regard, the first restrictive portion 411 the second restrictive portion 412, and the four (4) cam followers 170 are arranged on a virtual plane PL1, which is parallel to the setting plane FP.

As shown in FIG. 19A, the first restrictive portion 411 is located at an inner position, which is inward, or rearward, with respect to the second restrictive portion 412 in the drawing-out direction, and a position closer than the second restrictive portion 412 to the second side-frame 420 in the axial direction parallel to the rotation axis 50X of the photosensitive drum 50. In other words, while the first photosensitive drum 50Y is located at a position inward, or rearward, with respect to the second photosensitive drum 50M in the drawing-out direction, the first restrictive portion 411 is located at a position distanced farther than the second restrictive portion 412 from the second photosensitive drum 50M in the first direction and distanced farther than the second restrictive portion 412 from the first side-frame 410 in the second direction.

As shown in FIG. 19B, the first engageable portion 911 is a protrusion protruding rearward at an upper-rearward position in the first lateral wall 910. The first engageable portion 911 includes a first contact surface 211, which faces toward the second lateral wall 920 in the axial direction, arranged in an inner end region in the drawing-out direction, or the first direction. The first engageable portion 911 includes an oblique face 311 at a position between a rearward end face thereof and the first contact face 211.

As shown in FIG. 19C, the second engageable portion 912 is a protrusion protruding rearward at an upper-frontward position in the first lateral wall 910. The second engageable portion 912 includes a second contact face 212, which faces toward the second lateral wall 920 in the axial direction, arranged in an outer end region in the drawing-out direction, or the first direction. The second engageable portion 912 includes an oblique face 312 at a position between a rearward end face thereof and the second contact face 212.

As shown in FIG. 3, in the first side-frame 410 of the casing 10, arranged between the first restrictive portion 411 and the second restrictive portion 412 in the drawing-out direction are four (4) protrusions 415, each of which has a shape of a frustum of pyramid. In the present embodiment, the protrusions 415 are arranged at positions lower than the four (4) openings 470, in other words, at positions in one-to-one correspondence to the four (4) cam followers 170 in the drawing-out direction.

Meanwhile, as shown in FIG. 4, in the first lateral wall 910 in the drum unit 500, arranged on a side facing away from the second lateral wall 920 are four (4) protrusions 915, each of which has a shape of a frustum of pyramid.

As shown in FIG. 20, in a state where the drum unit 500 is attached to the casing 10, the protrusions 915 are located at positions, at which end faces 916 of the protrusions 915 contact end faces of the protrusions 415 in the first frame 410, respectively.

In the second side-frame 420, on the other hand, arranged are four (4) electrode springs ES. The electrode springs ES are arranged at positions symmetrical to the protrusions 415 about a virtual plane PL2, which is orthogonal to the second direction, or a direction parallel to the rotation axis 50X of the photosensitive drum 50 in the drum unit 500 being attached to the casing 10. In other words, the protrusions 415 in the first side-frames 410 are arranged such that the positions, at which the protrusions 415 contact the end faces 916 of the protrusions 915 in the first lateral wall 910, coincide in the second direction with the electrode springs EP. Each electrode spring ES is, in the state where the drum unit 500 is attached to the casing 10, electrically connected with the corresponding one of the developing cartridges 60 through a terminal, which is not shown but is arranged on the second lateral wall 920 in the drum unit 500, and urges the drum unit 500 in a direction from the second side-frame 420 toward the first side-frame 410, e.g., leftward.

The casing 10 is in an arrangement such that, in the state where the drum unit 500 is attached to the casing 10, the first restrictive portion 411 contacts the first contact face 211; the second restrictive portion 412 contacts the second contact face 212; and the four protrusions 415 contact the end faces 916 of the four protrusions 915 in the first lateral wall 910, i.e., a lateral face of the first lateral wall 910 facing away from the second lateral wall 920. Therefore, the drum unit 500 may be restricted from moving in the second direction, or in the direction from the first lateral wall 910 toward the second lateral wall 920 along the axial direction by the first and second restrictive portions 411, 412, and from moving in a direction opposite to the second direction by the protrusions 415 in the first side-frame 410 to locate the drum unit 500 at the correct position in the axial direction.

As shown in FIGS. 3 and 18, the first side-frame 410 is provided with a guide rail 480, which may support the first lateral wall 910 to aid the drum unit 50 to move in the front-rear direction along the first direction between the stored position and the drawn-out position. The second side-frame 420 is provided with a guide rail 480, which may support the second lateral wall 920 likewise. When the drum unit 500 is drawn outward from the casing 10 or pushed inward to be attached to the casing 10, rollers W may roll on the guide rails 480 arranged on the first side-frame 410 and the second side-frame 420. Thus, the drum unit 500 may be guided by the guide rails 480 to move with respect to the casing 10. At a rear end of each guide rail 480 arranged is a recessed portion 490, which recesses downward.

In the following paragraphs, described with reference to FIGS. 18 and 21A-21B will be exemplary procedure to attach the drum unit 500 to the casing 10. As shown in FIG. 21A, when the drum unit 500 is being pushed from the drawn-out position toward the stored position, the rollers W on the drum unit 500 supported by the guide rails 480 in the first side-frame 410 and the second side-frame 420 may roll to move rearward. In this instance, the first engageable portion 911 is separated from or disengaged from the first restrictive portion 411, and the second engageable portion 912 is separated from or disengaged from the second restrictive portion 412. Meanwhile, the four protrusions 915 are separated from the four protrusions 415, respectively, and the engageable recessed portion 930 is separated from the connecting pipe 440.

As the drum unit 500 is further pushed from the position shown in FIG. 21A inward closer to the stored position, as shown in FIG. 21B, the first restrictive portion 411 contacts the first contact face 211 of the first engageable portion 911, and the second restrictive portion 412 contacts the second contact face 212 of the second engageable portion 912. In particular, the oblique face 311 of the first engageable portion 911 and the oblique face 312 of the second engageable portion 912 may contact the first restrictive portion 411 and the second restrictive portion 412, respectively, substantially simultaneously. Meanwhile, the rollers W reach edges of the recessed portions 490, and the first engageable portion 911 and the second engageable portion 912 may engage with the first restrictive portion 411 and the second restrictive portion 412, respectively. In this instance, the first restrictive portion 411 and the second restrictive portion 412 are already in contact with the first contact face 211 and the second contact face 212, respectively, to restrict the drum unit 500 from moving in the second direction. Meanwhile, the engageable recessed portion 930 is not yet contacting but is separated from the connecting pipe 440.

As the drum unit 500 is further pushed from the position shown in FIG. 21B inward toward the stored position, the rollers W may fall in the recessed portions 490, and the drum unit 500 may move lower-rearward by the aid of the gravity to the stored position. In this instance, with the first restrictive portion 411 contacting the first engageable portion 911, and the second restrictive portion 412 contacting the second engageable portion 912, the end faces of the protrusions 415 contact the end faces 916 of the protrusions 915 so that the drum unit 500 may be located at a correct position in the widthwise direction being the direction parallel to the rotation axis 50X of the photosensitive drum 50. Moreover, as shown in FIG. 18, with the rollers W fallen and staying stably on the bottoms of the recessed portions 490, the drum unit 500 may be located at a correct position in the vertical direction; and with the engageable recessed portion 930 contacting to be engaged with the connecting pipe 440, the drum unit 500 may be placed at a correct position in the front-rear direction.

As described earlier, the cam follower 170, which is located at the position corresponding to the pressing face 182A of the developing cartridge 60 in the first side-frame 410, may push the corresponding developing cartridge 60 in the second direction (see FIG. 18) through the opening 914 in the second lateral wall 910 to move the developing roller 61 from the contacting position to the separated position (see FIGS. 6A-6B).

In particular, for multicolored image printing in the image forming apparatus 1 with use of the first developing roller 61Y, the second developing roller 61M, the third developing roller 61C, and the fourth developing roller 61K, in order to transfer the toner images to the sheet S, the first developing roller 61Y, the second developing roller 61M, the third developing roller 61C, and the fourth developing roller 61K may be moved to the respective contacting positions synchronously with the conveyance of the sheet S, and after the toner images are developed on the first, second, third, and fourth photosensitive drums 50Y, 50M, 50C, 50K, the first developing roller 61Y, the second developing roller 61M, the third developing roller 61C, and the fourth developing roller 61K may be moved to the respective separated positions.

In the following paragraphs, described with reference to FIGS. 22A-22D through 23A-23D will be pressing actions of the cam followers 170. Arrows in FIGS. 22A-22D through 23A-23D represent urging forces being caused by the cam followers 170.

When the sheet S is at a position not yet reached the first photosensitive drum 50Y, which is at the most upstream position in the sheet-moving direction, the first, second, third, and fourth developing rollers 61Y, 61M, 61C, 61K are all located at the separated positions. In this arrangement, as shown in FIG. 22A, the cam followers 170Y, 170M, 170C, 170K are all located at the operable positions, in which the cam followers 170Y, 170M, 170C, 170K press the first, second, third, and fourth developing cartridges 60Y, 60M, 60C, 60K, respectively.

As the sheet S approaches the first photosensitive drum 50Y in order to move the first developing roller 61Y and the second developing roller 61M to the contacting positions, as shown in FIG. 22B, the cam followers 170Y, 170M are moved to the standby positions while the cam followers 170C, 170K stay at the operable positions. In this arrangement, the cam followers 170C, 170K may press the third developing cartridge 60C and the fourth developing cartridge 60K, respectively, but the cam followers 170Y, 170M may not press the first developing cartridge 60Y or the second developing cartridge 60M.

As the sheet S approaches the second photosensitive drum 50M, in order to move the third developing cartridge 60C to locate the third developing roller 61C at the contacting position, as shown in FIG. 22C, the cam follower 170C is moved to the standby position while the cam follower 170K alone stays at the operable position. In this arrangement, the cam follower 170K may press the fourth developing cartridge 60K, but the cam followers 170Y, 170M, 170C may not press the first developing cartridge 60Y, the second developing cartridge 60M, or the third developing cartridge 60C.

As the sheet S approaches the third photosensitive drum 50C, in order to move the fourth developing cartridge 60K to locate the fourth developing roller 61K at the contacting position, as shown in FIG. 22D, the cam follower 170K is moved to the standby position. In this arrangement, the cam followers 170Y 170M, 170C, 170K are all located at the standby positions, where none of the first, second, third, or fourth developing cartridge 60Y, 60M, 60C, 60K is pressed.

When development of a toner image by the first developing roller 61Y on the first photosensitive drum 50Y is completed, in order to move the first developing cartridge 60Y to locate the first developing roller 61Y at the separated position, as shown in FIG. 23A, the cam follower 170Y is moved to the operable position. In this arrangement, the cam follower 170Y may press the first developing cartridge 60Y, but the cam followers 170M, 170C, 170K may not press the second, third, or fourth developing cartridge 60M, 60C, 60K.

When development of a toner image by the second developing roller 61M on the second photosensitive drum 50M is completed, in order to move the second developing cartridge 60M to locate the second developing roller 61M at the separated position, as shown in FIG. 23B, the cam follower 170M is moved to the operable position. In this arrangement, the cam followers 170Y, 170M may press the first and second developing cartridges 60Y, 60M, respectively, but the cam followers 170C, 170K may not press the third or fourth developing cartridge 60C, 60K.

When development of a toner image by the third developing roller 61C on the third photosensitive drum 50C is completed, in order to move the third developing cartridge 60C to locate the third developing roller 61C at the separated position, as shown in FIG. 23C, the cam follower 170C is moved to the operable position. In this arrangement, the cam followers 170Y, 170M, 170C may press the first, second, and third developing cartridges 60Y, 60M, 60C, respectively, but the cam follower 170K may not press the fourth developing cartridge 60K.

When development of a toner image by the fourth developing roller 61K on the fourth photosensitive drum 50K is completed, in order to move the fourth developing cartridge 60K to locate the fourth developing roller 61K at the separated position, as shown in FIG. 23D, the cam follower 170K is moved to the operable position. In this arrangement, the cam followers 170Y 170M, 170C, 170K may press the first, second, third, and fourth developing cartridges 60Y 60M, 60C, 60K, respectively.

Meanwhile, for monochrome image printing in the image forming apparatus 1 with use of the fourth developing roller 61K alone, similarly to the multicolored image printing described above, the cam followers 170Y, 170M, 170C, 170Y may be controlled such that, from the arrangement, in which the cam followers 170Y, 170M, 170C, 170Y are all located at the operable positions (see FIG. 23D), the cam follower 170K alone may be moved to the standby position (see FIG. 23C) as the sheet S approaches the fourth photosensitive drum 50K so that the fourth developing roller 61K alone may be moved to the separated position. In this arrangement, the cam followers 170K, 170M, 170C may press the first, second, and third developing cartridges 60Y 60M, 60C, respectively, but the cam follower 170K may not press the fourth developing cartridge 60K.

When development of a toner image by the fourth developing roller 61K on the fourth photosensitive drum 50K is completed, in order to move the fourth developing cartridge 60K to locate the fourth developing roller 61K at the separated position, as shown in FIG. 23D, the cam followers 170Y, 170M, 170C, 170K may return to the arrangement, in which the cam followers 170Y 170M, 170C, 170K may press the first, second, third, and fourth developing cartridges 60Y, 60M, 60C, 60K, respectively.

Benefits achievable by the image forming apparatus 1 described above will be described below.

With the first and second restrictive portions 411, 412, which may restrict the drum unit 50 being attached to the casing 10 from moving in the second direction, i.e., the direction from the first lateral wall 910 toward the second lateral wall 920, along the rotation axis 50X of the photosensitive drum 50, the drum unit 500 may be located at a correct position in the axial direction and stabilized thereat. Therefore, the photosensitive drum 50 may be located at a correct position with respect to the exposure device 40, which is fixed to the connecting plate 430 of the casing 10, and positional deviation of electrostatic latent images on the photosensitive drum 50 to be formed by the exposure device 40 may be restrained.

In particular, in the configuration as described above such that the cam follower 170 to move the developing roller 61 from the contacting position to the separated position may move the developing cartridge 60 in the second direction, displacement of the drum unit 500 in the second direction due to the pressing force from the cam follower 170 in the second direction while the drum unit 500 is supported by the developing cartridge 60 may be restrained.

Moreover, when the image forming apparatus 1 is a multicolor printer as described in the embodiment above, in which the drum unit 500 has the plurality of photosensitive drums 50, the plurality of cam followers 170 aligning along the drawing-out direction of the drum unit 500 may press the plurality of developing cartridges 60 in different timings. In this regard, reaction forces that may deform or twist the drum unit 500 may be applied to the drum unit 500. However, with the first restrictive portion 411 and the second restrictive portion 412, which are arranged to be spaced apart in the drawing-out direction, or the first direction, the drum unit 500 may be restrained from being deformed or twisted.

Moreover, with the first restrictive portion 411 and the second restrictive portion 412 being arranged at the same height H as the cam follower 170, which may press the developing cartridge 60, deformation and displacement of the drum unit 500 in the axial direction may be restrained.

When the drum unit 500 is attached to the casing 10, the first restrictive portion 411 contacts the first contact face 211 of the first engageable portion 911 in the first lateral wall 910, which faces toward the second lateral wall 920 along the axial direction; the second restrictive portion 412 contacts the second contact face 212 of the second engageable portion 912 in the first lateral wall 910, which faces toward the second lateral wall 920 along the axial direction; and the protrusions 415 arranged between the first restrictive portion 411 and the second restrictive portion 412 contact a side face of the first lateral wall 910, including the end faces 916 of the protrusions 915, facing away from the second lateral wall 920 along the axial direction. Therefore, the first lateral wall 910 may be fitted at both sides in the axial direction to be stabilized in the correct position.

When the drum unit 500 is attached to the casing 10, the protrusions 415 are arranged at positions corresponding to the electrode springs ES, which may urge the drum unit 500 against the first side-frame 410, so that the urging force by the electrode springs ES may be reliably received by the first side-frame 410. Therefore, displacement of the drum unit 500 in the direction toward the first side-frame 410 may be restrained.

The first restrictive portion 411 is arranged at the position inward with respect to the second restrictive portion 412 in the drawing-out direction and closer than the second restrictive portion 412 to the second side-frame 420 in the axial direction. Therefore, while the drum unit 500 is guided by the guide rails 408 to be pushed inward from the drawn-out position to the stored position, the drum unit 500 may be moved smoothly without interference of the first engageable portion 911 against the second restrictive portion 412.

Moreover, at the end of the procedure to attach the drum unit 500 to the casing 10, the first restrictive portion 411, the second restrictive portion 412, and the protrusions 415 may work earlier to place the drum unit 500 in the correct position in the axial direction than the engagement of the engageable recessed portions 930 in the first lateral wall 910 and the second lateral wall 920 with the connecting pipe 440 to place the drum unit 500 in the correct position in the drawing-out direction. Therefore, the connecting pipe 440 may be restrained from being scraped by the engageable recessed portions 930 upon and after engagement of the engageable recessed portions 930 with the connecting pipe 440 due to the axial movement of the drum unit 500 which may otherwise be caused in order to place the drum unit 500 at the correct position in the axial direction later.

Although an example of carrying out the invention has been described, those skilled in the art will appreciate that there are numerous variations and permutations of the image forming apparatus that fall within the spirit and scope of the invention as set forth in the appended claims. It is to be understood that the subject matter defined in the appended claims is not necessarily limited to the specific features or act described above. Rather, the specific features and acts described above are disclosed as example forms of implementing the claims.

For example, the cam follower 170 may not necessarily be movable between the operable position and the standby position by the cam 150 which is rotatable but may be movable between the operable position and the standby position by a linear motion cam, which may move linearly. For another example, a linear-motion motor such as a solenoid motor which is movable between the operable position and the standby position may press the developing cartridge. For another example, the developing cartridge may be pressed directly by a cam.

For another example, the position of the drum unit 500 in the axial direction may not necessarily be restricted by two restrictive portions, i.e., the first restrictive portion 411 and the second restrictive portion 412, and the locator formation being the plurality of protrusions 415 between the two restrictive portions on the casing 10: the casing 10 may provide solely one restrictive portion or three or more restrictive portions. Moreover, a quantity and/or arrangement of the protrusions 415 may not necessarily be limited to those illustrated in the embodiment described above.

Moreover, the positions of the restrictive portions on the casing 10 may not necessarily be limited to those illustrated in the embodiment described above. For example, the restrictive portion may not necessarily be arranged on the first side-frame 410 but may be arranged on an inner side of the second side-frame 420. When the casing 10 provides two or more restrictive portions, the restrictive portions may not necessarily be arranged at the same height as the cam follower 170 but may be arranged at vertically different positions. Moreover, as long as the restrictive portions do not interfere with the drum unit 500 being attached to the casing 10, the first restrictive portion on the inner position in the drawing-out direction may not necessarily be arranged at the position closer than the second restrictive portion to the side frame on the opposite side. With the restrictive portion arranged at a preferable position in adjacent to the drum unit 500 attached to the casing 10, the drum unit 500 may be placed at the correct position in the second direction and may be restrained from being displaced upon or after the attachment to the casing 10. For another example, depending on an arrangement of the restrictive portion(s), the locator formation may be omittable.

For another example, the image forming apparatus 1 may not necessarily be limited to the image forming apparatus for forming multicolored images in the toners of four colors but may be an image forming apparatus for forming multicolored images in toners of three colors, five colors, or a different number of colors.

For another example, the image forming apparatus may be a multifunction peripheral machine or a copier.

What is claimed is:

1. An image forming apparatus, comprising:

a casing;

a drum unit detachably attachable to the casing, the drum unit being detachable from the casing by being drawn outward in a drawing-out direction with respect to the casing, the drum unit comprising:

a first lateral wall and a second lateral wall arranged to be spaced apart from each other in a direction orthogonal to the drawing-out direction; and a first photosensitive drum and a second photosensitive drum arranged to be spaced apart from each other in the drawing-out direction, the first photosensitive drum and the second photosensitive drum being supported rotatably by the first lateral wall and the second lateral wall to rotate about axes extending orthogonally to the drawing-out direction;

a first developing cartridge supported by the drum unit at a position corresponding to the first photosensitive drum, the first developing cartridge comprising a first developing roller, the first developing roller being configured to contact the first photosensitive drum, the first developing cartridge being movable between a position, in which the first developing roller is located at a contacting position to contact the first photosensitive drum, and a position, in which the first developing roller is located at a separated position to be separated from the first photosensitive drum;

a second developing cartridge supported by the drum unit at a position corresponding to the second photosensitive drum, the second developing cartridge comprising a second developing roller, the second developing roller being configured to contact the second photosensitive drum, the second developing cartridge being movable between a position, in which the second developing roller is located at a contacting position to contact the second photosensitive drum, and a position, in which the second developing roller is located at a separated position to be separated from the second photosensitive drum;

a first operable member arranged in the casing at a position corresponding to the first developing cartridge, the first operable member being configured to press the first developing cartridge in a direction from the first lateral wall toward the second lateral wall to move the first developing roller from the contacting position to the separated position; and a second operable member arranged in the casing at a position corresponding to the second developing cartridge, the second operable member being configured to press the second developing cartridge in the direction from the first lateral wall toward the second lateral wall to move the second developing roller from the contacting position to the separated position, wherein the casing comprises a restrictive portion; and wherein, when the drum unit is attached to the casing, the restrictive portion restricts movement of the drum unit causable by at least one of a pressing action of the first operable member to press the first developing cartridge and a pressing action of the second operable member to press the second developing cartridge.

2. The image forming apparatus according to claim 1, further comprising:

a first cam and a second cam, wherein the first operable member comprises a first cam follower, the first cam follower being configured to be moved by the first cam between an operable position, in which the first cam follower presses the first developing cartridge, and a standby position, in which the first cam follower does not press the first developing cartridge; and wherein the second operable member comprises a second cam follower, the second cam follower being configured to be moved by the second cam between an operable position, in which the second cam follower presses the second developing cartridge, and a standby position, in which the second cam follower does not press the second developing cartridge.

3. The image forming apparatus according to claim 1, wherein the casing comprises a first side-frame and a second side-frame;

wherein, when the drum unit is attached to the casing, the first side-frame covers a sideward face of the first lateral wall facing opposite to the second lateral wall in an axial direction being a direction of the axes of the first photosensitive drum and the second photosensitive drum;

wherein, when the drum unit is attached to the casing, the second side-frame covers a sideward face of the second lateral wall facing opposite to the first lateral wall in the axial direction; and wherein the restrictive portion includes a first restrictive portion and a second restrictive portion arranged in the first side-frame at positions spaced apart from each other in the drawing-out direction.

4. The image forming apparatus according to claim 3, wherein, when the image forming apparatus is situated on a setting plane, and when the drum unit is attached to the casing, a height between the setting plane and the first restrictive portion, a height between the setting plane and the second restrictive portion, a height between the setting plane and the first operable member, and a height between the setting plane and the second operable member are equal.

5. The image forming apparatus according to claim 4, wherein the first restrictive portion is located at an inner position with respect to the second restrictive portion in the drawing-out direction and a position closer than the second restrictive portion to the second side-frame in the axial direction.

6. The image forming apparatus according to claim 3, wherein the casing further includes a locator portion arranged between the first restrictive portion and the second restrictive portion in the drawing-out direction;

wherein the first lateral wall includes:

a first contact face arranged in an inner end region in the first lateral wall in the drawing-out direction, the first contact face facing toward the second lateral wall; and a second contact face arranged in an outer end region in the lateral wall in the drawing-out direction, the second contact face facing toward the second lateral wall; and wherein, when the drum unit is attached to the casing, the first restrictive portion contacts the first contact face, the second restrictive portion contacts the second contact face, and the locator portion contacts a sideward face of the first lateral wall facing opposite to the second lateral wall.

7. The image forming apparatus according to claim 6, wherein the locator portion includes a first protrusion arranged at a position corresponding in the drawing-out direction to the first operable member and a second protrusion arranged at a position corresponding in the drawing-out direction to the second operable member.

8. The image forming apparatus according to claim 7, further comprising a first electrode spring and a second electrode spring, wherein, when the drum unit is attached to the casing, the first electrode spring is electrically connected with the first developing cartridge and urges the drum unit in a direction from the second side-frame toward the first side-frame; and wherein, when the drum unit is attached to the casing, the second electrode spring is electrically connected with the second developing cartridge and urges the drum unit in the direction from the second side-frame toward the first side-frame; and wherein the first electrode spring and the second electrode spring are arranged at positions symmetrical to the first protrusion and the second protrusion, respectively, about a virtual plane extending orthogonally to the axial direction.

9. The image forming apparatus according to claim 3, wherein the casing further comprises a connecting member connecting an inner end portion of the first side-frame and an inner end portion of the second side-frame in the drawing-out direction with each other;

wherein, when the drum unit is attached to the casing, engagement of the first lateral wall and the second lateral wall with the connecting member locates the drum unit at a predetermined position in the drawing-out direction with respect to the casing; and wherein, when the drum unit is being attached to the casing, the restrictive portion restricts the first lateral wall from moving in the axial direction prior to the engagement of the first lateral wall and the second lateral wall with the connecting member.

10. The image forming apparatus according to claim 3, further comprising:

an exposure device configured to expose the first photosensitive drum and the second photosensitive drum, and wherein the casing further comprises a connecting plate connecting the first side-frame and the second side-frame with each other; and wherein the exposure device is fixed to the connecting plate.

11. An image forming apparatus, comprising:

a casing comprising a first side-frame;

a drum unit configured to be drawn outward in a first direction with respect to the casing, the drum unit comprising:

a first lateral wall comprising a first opening and a second opening;

a second lateral wall arranged to be spaced apart from the first lateral wall in a second direction, the second direction extending orthogonally to the first direction;

a first photosensitive drum arranged between the first lateral wall and the second lateral wall rotatably to rotate about a rotation axis being parallel to the second direction; and a second photosensitive drum arranged between the first lateral wall and the second lateral wall at a position spaced apart from the first photosensitive drum in the first direction rotatably to rotate about a rotation axis being parallel to the second direction, the drum unit being supported by the first side-frame through the first lateral wall to be movable along the first direction between a stored position, in which the first photosensitive drum and the second photosensitive drum are located inside the casing, and a drawn-out position, in which the first photosensitive drum and the second photosensitive drum are located outside the casing;

a first developing cartridge comprising a first developing roller, the first developing cartridge being movable, when the first developing cartridge is attached to the drum unit, between a position, in which the first developing roller being located at a contacting position contacts the first photosensitive drum, and a position, in which the first developing roller being located at a separated position is separated from the first photosensitive drum;

a second developing cartridge comprising a second developing roller, the second developing cartridge being movable, when the second developing cartridge is attached to the drum unit, between a position, in which the second developing roller being located at a contacting position contacts the second photosensitive drum, and a position, in which the second developing roller being located at a separated position is separated from the second photosensitive drum;

a first operable member arranged on the first side-frame at a position corresponding to the first developing cartridge, the first operable member being configured to move through the first opening in the first lateral wall and press the first developing cartridge in the second direction to move the first developing roller from the contacting position to the separated position; and a second operable member arranged on the first side-frame at a position corresponding to the second developing cartridge, the second operable member being configured to move through the second opening in the first lateral wall and press the second developing cartridge in the second direction to move the second developing roller from the contacting position to the separated position, wherein the first lateral wall comprises a first engageable portion and a second engageable portion, the second engageable portion being arranged at a position spaced apart from the first engageable portion in the first direction;

wherein the first side-frame comprises a first restrictive portion and a second restrictive portion;

wherein, when the drum unit is located at the stored position, engagement of the first engageable portion with the first restrictive portion and engagement of the second engageable portion with the second restrictive portion restrict movement of the drum unit causable by at least one of a pressing action of the first operable member to press the first developing cartridge and a pressing action of the second operable member to press the second developing cartridge; and wherein, when the drum unit is located at the drawn-out position, the first engageable portion is disengaged from the first restrictive portion and the second engageable portion is disengaged from the second restrictive portion.

12. The image forming apparatus according to claim 11, wherein, when the image forming apparatus is situated on a setting plane, and when the drum unit is attached to the easing, a height between the setting plane and the first restrictive portion, a height between the setting plane and the second restrictive portion, a height between the setting plane and the first operable member, and a height between the setting plane and the second operable member are equal.

13. The image forming apparatus according to claim 12, wherein the first restrictive portion is located at a position distanced farther than the second restrictive portion from the second photosensitive drum in the first direction and distanced farther than the second restrictive portion from the first side-frame in the second direction.

14. The image forming apparatus according to claim 11, wherein the casing further comprises a second side-frame, the second side-frame being configured to support the second lateral wall of the drum unit to aid the drum unit to move along the first direction between the stored position and the drawn-out position, wherein the image forming apparatus further comprises a first electrode spring and a second electrode spring;

wherein, when the drum unit is attached to the casing, the first electrode spring is electrically connected with the first developing cartridge and urges the drum unit in a direction from the second side-frame toward the first side-frame; and wherein, when the drum unit is attached to the casing, the second electrode spring is electrically connected with the second developing cartridge and urges the drum unit in the direction from the second side-frame toward the first side-frame.

15. The image forming apparatus according to claim 11, wherein the casing further comprises:

a second side-frame configured to support the second lateral wall of the drum unit to aid the drum unit to be move along the first direction between the stored position and the drawn-out position;

a connecting member connecting the first side-frame and the second side-frame with each other, the connecting member being configured to, when the drum unit is located at the stored position with the first lateral wall and the second lateral wall contacting the connecting member, locate the drum unit at a correct position with respect to the casing in the first direction; and wherein, when the drum unit moves from the drawn-out position to the stored position, movement of the drum unit in the second direction is restricted earlier by the engagement of the first engageable portion with the first restrictive portion and the engagement of the second engageable portion with the second restrictive portion, and movement of the drum unit in the first direction is restricted later by contact of the first lateral wall and the second lateral wall with the connecting member.

16. An image forming apparatus, comprising:

a casing;

a drum unit configured to be drawn outward in a first direction from the casing, the drum unit comprising:

a first lateral wall comprising a first engageable portion and a second engageable portion, the second engageable portion being arranged to be spaced apart from the first engageable portion in the first direction;

a second lateral wall arranged to be spaced apart from the first lateral wall in a second direction, the second direction extending orthogonally to the first direction; and a photosensitive drum arranged between the first lateral wall and the second lateral wall rotatably to rotate about a rotation axis being parallel to the second direction;

a first side-frame arranged inside the casing, the first side-frame being configured to support the first lateral wall movably to aid the drum unit to move along the first direction between a stored position, in which the photosensitive drum is located inside the casing, and a drawn-out position, in which the photosensitive drum is located outside the casing, the first side-frame comprising:

a first restrictive portion configured to, when the drum unit is located at the stored position, engage with the first engageable portion; and a second restrictive portion configured to, when the drum unit is located at the stored position, engage with the second engageable portion;

a second side-frame arranged inside the casing to be spaced apart from the first side-frame in the second direction; and a connecting member connecting the first side-frame and the second side-frame with each other, the connecting member being configured to, when the drum unit is located at the stored position with the first lateral wall and the second lateral wall contacting the connecting member, locate the drum unit at a correct position with respect to the casing in the first direction, wherein, when the drum unit moves from the drawn-out position to the stored position, movement of the drum unit in the second direction is restricted earlier by the engagement of the first engageable portion with the first restrictive portion and the engagement of the second engageable portion with the second restrictive portion, and movement of the drum unit in the first direction is restricted later by contact of the first lateral wall and the second lateral wall with the connecting member.

17. An image forming apparatus, comprising:

a casing comprising a side frame;

a drum unit configured to be drawn outward in a first direction with respect to the casing, the drum unit comprising:

a first lateral wall comprising an opening;

a second lateral wall arranged to be spaced apart from the first lateral wall in a second direction, the second direction extending orthogonally to the first direction;

a photosensitive drum arranged between the first lateral wall and the second lateral wall, the photosensitive drum being rotatable about a rotation axis being parallel to the second direction, the drum unit being supported by the side frame through the first lateral wall to be movable along the first direction between a stored position, in which the photosensitive drum is located inside the casing, and a drawn-out position, in which the photosensitive drum is located outside the casing;

a developing cartridge comprising a developing roller, the developing cartridge being movable between a first position, in which the developing roller contacts the photosensitive drum, and a second position, in which the developing roller is separated from the photosensitive drum; and an operable member arranged on the side frame at a position corresponding to the developing cartridge, the operable member being configured to move through the opening in the first lateral wall and press the developing cartridge in the second direction to move the developing cartridge from the first position to the second position, wherein the first lateral wall comprises a first engageable portion and a second engageable portion, the second engageable portion being arranged at a position spaced apart from the first engageable portion in the first direction;

wherein the side frame comprises a first restrictive portion and a second restrictive portion;

wherein, when the drum unit is located at the stored position, engagement of the first engageable portion with the first restrictive portion and engagement of the second engageable portion with the second restrictive portion restrict movement of the drum unit causable by a pressing action of the operable member to press the developing cartridge; and wherein, when the drum unit is located at the drawn-out position, the first engageable portion is disengaged from the first restrictive portion and the second engageable portion is disengaged from the second restrictive portion.

18. An image forming apparatus, comprising:

a casing;

a supporting member movable in a drawing-out direction with respect to the casing, the supporting member comprising a first lateral wall and a second lateral wall arranged to be spaced apart from each other in a direction orthogonal to the drawing-out direction;

a first cartridge supported by the supporting member, the first cartridge comprising a first developing roller, the first developing roller being movable between a first contacting position, in which the first developing roller contacts a first photosensitive drum, and a first separated position, in which the first developing roller is separated from the first photosensitive drum;

a second cartridge supported by the supporting member, the second cartridge comprising a second developing roller, the second developing roller being movable between a second contacting position, in which the second developing roller contacts a second photosensitive drum, and a second separated position, in which the second developing roller is separated from the second photosensitive drum;

a first operable member arranged in the casing at a position corresponding to the first cartridge, the first operable member being configured to press the first cartridge in a direction from the first lateral wall toward the second lateral wall to move the first developing roller from the first contacting position to the first separated position; and a second operable member arranged in the casing at a position corresponding to the second cartridge, the second operable member being configured to press the second cartridge in the direction from the first lateral wall toward the second lateral wall to move the second developing roller from the second contacting position to the second separated position, wherein the casing comprises a restrictive portion, the restrictive portion being configured to restrict movement of the supporting member causable by at least one of a pressing action of the first operable member to press the first cartridge and a pressing action of the second operable member to press the second cartridge.

19. The image forming apparatus according to claim 18, further comprising:

a first cam and a second cam, wherein the first operable member comprises a first cam follower, the first cam follower being configured to be moved by the first cam between an operable position, in which the first cam follower presses the first cartridge, and a standby position, in which the first cam follower does not press the first cartridge; and wherein the second operable member comprises a second cam follower, the second cam follower being configured to be moved by the second cam between an operable position, in which the second cam follower presses the second cartridge, and a standby position, in which the second cam follower does not press the second cartridge.

20. The image forming apparatus according to claim 18, wherein the casing comprises a first side-frame and a second side-frame;

wherein the first photosensitive drum and the second photosensitive drum are rotatable about axes extending orthogonally to the drawing-out direction;

wherein the first side-frame is configured to cover a sideward face of the first lateral wall facing opposite to the second lateral wall in an axial direction being a direction of the axes of the first photosensitive drum and the second photosensitive drum;

wherein the second side-frame is configured to cover a sideward face of the second lateral wall facing opposite to the first lateral wall in the axial direction; and wherein the restrictive portion includes a first restrictive portion and a second restrictive portion arranged in the first side-frame at positions spaced apart from each other in the drawing- out direction.

21. The image forming apparatus according to claim 20, wherein, when the image forming apparatus is situated on a setting plane, a height between the setting plane and the first restrictive portion, a height between the setting plane and the second restrictive portion, a height between the setting plane and the first operable member, and a height between the setting plane and the second operable member are equal.

22. The image forming apparatus according to claim 20, wherein the casing further includes a locator portion arranged between the first restrictive portion and the second restrictive portion in the drawing-out direction;

wherein the first lateral wall includes:

a first contact face arranged in an inner end region in the first lateral wall in the drawing-out direction, the first contact face facing toward the second lateral wall; and a second contact face arranged in an outer end region in the lateral wall in the drawing-out direction, the second contact face facing toward the second lateral wall; and wherein the first restrictive portion is configured to contact the first contact face, the second restrictive portion is configured to contact the second contact face, and the locator portion is configured to contact the sideward face of the first lateral.

* * * * *